US006976419B1

(12) United States Patent
Miyamoto et al.

(10) Patent No.: US 6,976,419 B1
(45) Date of Patent: Dec. 20, 2005

(54) SURFACE PIT FORMING METHOD AND MEMBER WITH SURFACE PIT

(75) Inventors: Noritaka Miyamoto, Toyota (JP); Kouta Kodama, Toyota (JP); Ikuo Marumoto, Anjyo (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 135 days.

(21) Appl. No.: 10/111,811

(22) PCT Filed: Nov. 2, 2000

(86) PCT No.: PCT/JP00/07766

§ 371 (c)(1),
(2), (4) Date: Apr. 29, 2002

(87) PCT Pub. No.: WO01/32352

PCT Pub. Date: May 10, 2001

(30) Foreign Application Priority Data

Nov. 4, 1999 (JP) ..... 11-313664

(51) Int. Cl.[7] ..... F01B 31/10
(52) U.S. Cl. ..... 92/153; 83/177
(58) Field of Search ..... 92/153; 83/177

(56) References Cited

U.S. PATENT DOCUMENTS

| | | | | |
|---|---|---|---|---|
| 2,085,976 A | * | 7/1937 | Heintz | 92/153 |
| 3,593,406 A | * | 7/1971 | Jones et al. | 92/169.1 |
| 3,727,524 A | * | 4/1973 | Nishiyama et al. | 92/169.1 |
| 4,258,084 A | * | 3/1981 | Hayden | 427/239 |
| 5,199,481 A | * | 4/1993 | Corwin et al. | 164/98 |
| 5,372,775 A | * | 12/1994 | Hayashi et al. | 419/12 |
| 5,380,564 A | | 1/1995 | VanKuiken, Jr. et al. | |
| 6,126,524 A | * | 10/2000 | Shepherd | 83/177 |

FOREIGN PATENT DOCUMENTS

| | | |
|---|---|---|
| EP | 0 430 856 A1 | 6/1991 |
| EP | 0 568 315 A1 | 11/1993 |
| EP | 0 716 158 A1 | 6/1996 |
| JP | A 62-147042 | 7/1987 |
| JP | A 62-260028 | 11/1987 |
| JP | A 2-294423 | 12/1990 |
| JP | B2 4-81000 | 12/1992 |
| JP | A 6-137209 | 5/1994 |
| JP | A 9-89498 | 4/1997 |

OTHER PUBLICATIONS

Aluminum and Aluminum Alloys, Materials Park, Ohio, ASM International, 1993, pp 160–178, TA480A6A6177, 1993.*

"The Advanced Surface Reforming Technique", Aug. 23, 1999, pp. 15–25.

* cited by examiner

*Primary Examiner*—F. Daniel Lopez
(74) *Attorney, Agent, or Firm*—Oliff & Berridge, PLC

(57) ABSTRACT

A forming method is provided that has surface pits, and the formed product thereof including a member adjust step for obtaining a member having a surface layer portion constructed by weak portions and high strength portion of relatively higher strength than the weak portions; and an inject step for injecting high pressure fluid to a surface of the member to remove at least a part of the weak portions for forming pits.

That is, the weak portions are presented on the surface layer portion of the member on which the surface pits are to be formed. The high pressure fluid is injected to the surface layer portion to remove the weak portions from the member surface layer portion. The removed portion in the weak portions form the pits.

16 Claims, 20 Drawing Sheets

(BEFORE TREATMENT)

(AFTER TREATMENT)

×400

×50

(x100)

SURFACE PIT FORMING METHOD AND MEMBER WITH SURFACE PIT

TECHNICAL FIELD

The present invention relates to a forming method of surface pits and member with the surface pits.

BACKGROUND ART

With recent increased concern for an earth environment, better rate of fuel consumption (mileage) of an automobile is urgently required from energy save aspect. For realizing mileage of the automobile, decreasing mechanical loss of an engine is effective. Main mechanical loss is a piston drive loss resulted from slide resistance between a piston and an engine cylinder liner.

For decreasing the piston drive loss generally, a slide surface of the engine cylinder liner is lubricated by an oil film formed thereon. For formation of the oil film on the surface stably, pits becoming as oil storage are preferably formed.

Thus, the pits on the member are formed by forming cross-hatch simultaneous with cutting and grinding the member surface, or by forming convexes and concaves by shot peening.

However, conventional surface pit forming methods may cause following inconveniences. That is, in both of forming the cross-hatch and forming the convexes and concaves by shot peening, the pits formed have shallow depth. Also, in the pit formation, the pits unselectively formed make the whole surface coarse. As the result, performance of the surface as the slide surface is deteriorated. In addition, fine alumina powders used by the shot peening is hardly recycled.

SUMMARY OF THE INVENTION

In view of the above circumstances, the present invention intends to provide forming method of the surface pits and the member with the surface pits, more excellent than the prior art.

That is, the forming method of surface pits of the present invention comprises a member adjust step for obtaining a member having a surface layer portion constructed by weak portions which are solid, and high strength portion which have relatively higher strength than weak portions; and an inject step for injecting high pressure fluid to remove at least a part of the weak portion for forming pits on the surface of the member after the member adjust step.

In other words, the weak portions are presented on the surface layer portion of the member on which the surface pits are to be formed. Then, the high pressure fluid is injected to the surface layer portion to remove the weak portions from the member surface layer portion. The removed portions on the weak portions become the pits.

The weak portions being easy removable by the high pressure fluid, will be removed in higher probability than the high strength portion from the member surface layer portion. The high strength portion is preferably not removed in the combination of the lowest inject pressure and inject time of the high pressure fluid in which the weak portions are removed, from control aspect of the number, size and depth of the surface pits. Portions other than the weak portions on the member surface layer portion are maintained in the original configuration before the forming method of surface pits of the present invention is applied. For this reason, even if flatten treatment and the like finally required for the member is performed for the member surface before the inject step, flatten degree of the member surface can be maintained after the forming method of the surface pits of the present invention is applied.

For removing the weak portions, force applied thereto must exceed bonding force between the respective weak portions and the high strength portion. As inject pressure of the high pressure fluid become higher, the number of the weak portions to be removed by the inject pressure increases. Since removal of the weak portions proceeds depending on probability, as inject time of the high pressure fluid becomes larger, remove probability of the weak portions becomes higher as a whole. Accordingly, changing the inject pressure and inject time of the high pressure fluid can control the number, size and depth of the surface pits to be formed on the member surface.

Inject pressure and inject time of the high pressure fluid are selected in range so that the high strength portion is hardly removed compared with the weak portions on the member surface as the member to be processed. If the high strength portion are removed similar to the weak portions, the surface layer portion of the member is removed uniformly.

Variously kinds of the high pressure fluids can be selected to control the number of the surface pits, and size and depth of the pits. The high pressure fluid can be liquid such as a water or an oil, or mixture of liquid and fine powders such as garnet powders and glass beads to increase removability of the weak portions. Also, the high pressure fluid can be fine particles, and an additive such as rust prevent agent and the like can be added to the high pressure fluid corresponding to nature of the member as the member to be processed.

Thus, the desired number and the desired shape of the pits can be formed, and only the weak portions on the member surface can be selectively removed by the present forming method, different from forming method of the surface pits by the shot peening and the like. As the result, surface of the portions other than the pits are not influenced.

In the inject step, removing, at least a part of the high strength portion adjacent to the weak portions likewisely can make size and depth of the pits larger compared with only the weak portions being removed.

For removing the high strength portion adjacent to the weak portions in addition to the weak portions from the member surface layer portion, inject pressure of the high pressure fluid can increase, or fine powders can be mixed into the high pressure fluid. For easy removal of the high strength portion, it can be surrounded by the weak portions. Also, the high strength portion constructed by crystal material are easily peeled at the crystal boundary surface.

In the inject process, the high pressure fluid can be injected only to the part of the surface layer portion.

Partial injection of the high pressure fluid on the surface layer portion can control forming location, forming density and forming interval of the pits and the like. Thus, the member having the surface suitable for using purpose can be obtained.

The weak portions can have a flaked shape, plate shape or fiber state. Shape of the weak portions having large aspect ratio can form the deep surface pits on the member without changing nature of the member surface.

The surface layer portion is preferably made of flake graphite cast iron.

The flake graphite cast iron is material used for a slide surface of a cylinder liner or the like. The flake graphite particles presented on a surface portion will be removed as the weak portions by injection of the high fluid pressure to form the pits. Needless to say, the flake graphite cast iron can be used only for the whole member, as well as for the surface layer portion. Density of the flake graphite particles can be controlled by cast condition and the like to obtain the surface pits required. In this case, deposit of the flake graphite particles is controlled in the member adjust step.

Also, the surface layer portion is preferably made of PMC aluminum in which mixed alminum alloy powders and hard particles are formed and sintered. The hard particles can be at least one of the ceramics powders and silicone particles.

Also, the surface layer portion is preferably made of MMC aluminum in which mullite particles and alumina-silica fibers are dispersed in the aluminum base.

The member adjust step can be a complex flame spray or complex plating. Forming the surface layer portion comprising more than two materials, and formed by the complex flame spray or complex can form the weak portions and high strength portion freely.

Further, the member with surface pits of the present invention for overcoming the above subject has the surface layer portion comprised of the weak portions which are solid, and the high strength portion having relatively higher strength than the weak portions. Also, it has the pits formed by removing the part of the weak portions of the surface layer portion by injection of the high pressure fluid.

That is, the member with surface pits of the present invention is comprised of the weak portions which are solid and the high strength portion, and the part of the surface layer portion of the member is selectively removed by injection of the high pressure fluid. The member has the pits on the surface with maintaining original surface configuration of the other portions.

An average value of distance between the pits is preferably 20 times to 200 times of an average depth of the pits. Average distance between the pits smaller than this value makes surface roughness of the member larger to increase friction coefficient suddenly. Also, when average distance between the pits larger than this value makes effect of the pits as the oil storage relatively small to cause scuff due to shortage of the oil.

The surface layer portion has the portion to which the high pressure fluid is injected and the portion to which it is not injected. Average value of length of the portion the high pressure fluid being not injected is preferably selected larger than that of the portion the high pressure fluid being injected, and can be 20 times to 200 times of the average value of the pit depth. When the average value of length of the portion the high pressure fluid being not injected is smaller than that of the portion the high pressure fluid being injected, influence of distance between the pits in the portion the high pressure fluid being injected becomes relatively larger. When average value of length of the portion the high pressure fluid being not injected is smaller than the average 20 to 200 times of value of the pit depth, surface roughness of the member becomes larger to increase friction coefficient suddenly. To the contrary, average value of length of the portion the higher pressure fluid being not injected is larger than the average value of the pit depth, effect of the pits as the oil storage becomes relatively small to cause scuff due to shortage of the oil.

The member with the surface pits is preferably made of flake graphite cast iron, and the pits are preferably formed by graphite particles removed. This is because in the flake graphite cast iron the pits can be controlled easily.

Surface of the member having pits is preferably flat. Flat surface is convenient when the member is used as the slide member.

The surface of the member having pits can be a surface of a cylinder bore or cylinder liner of an engine, a surface of a cylinder bore or cylinder liner of a compressor, or a surface of swash plate or shoe of the swash-plate fashion volume-variable type compressor. In addition, the member with surface pits of the present invention can be used for a member having a slide surface.

BEST MODE FOR EMBODYING THE INVENTION

<Forming method of surface pits>

Figure 1:
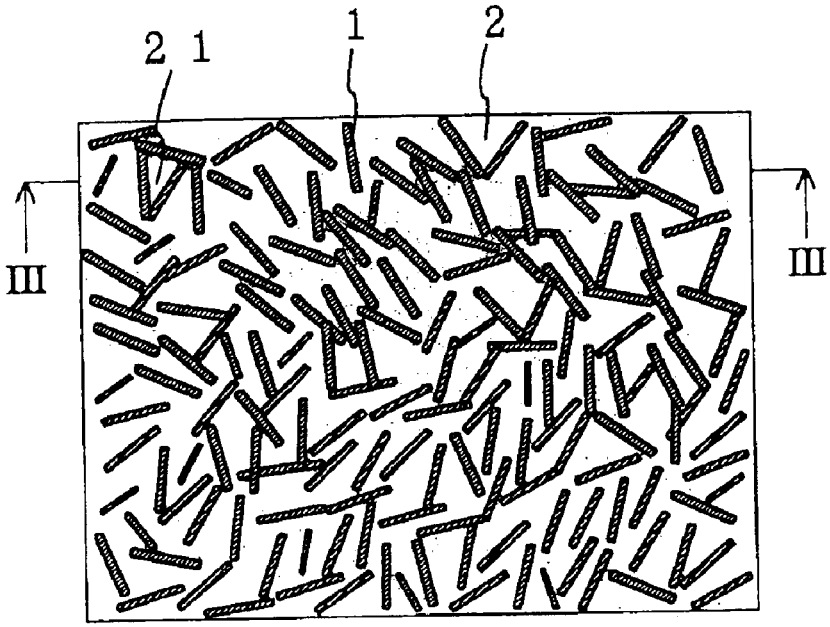
FIG. 1 is a figure showing one sample of a member surface adjusted by member adjust step of the present embodying mode.

In the following, embodying modes for forming method of surface pits according to the present invention will be explained in detail. It is noted the present invention is not limited to these embodying modes. Also noted is attached drawings show schematic in figures, not showing accurate dimension or shape.

In this embodying mode, a forming method for forming surface pits on a cylinder liner which has a slide surface sliding relative to a piston in an automobile engine will be explained. This forming method can be applied to a member having a slide surface sliding between members. For example, the member can include cylinder bore, a cylinder liner or cylinder bore of an engine other than automobile, a cylinder bore or cylinder liner of a compressor, a swash plate or shoe of a swash-plate fashion volume-variable type compressor. The forming method can be applied to a member which needs to contain lubricant agent on the surface continuously. Material of the member is not limited but can be metal material such as iron base material or resin.

The forming method of surface pits of the present invention comprises a member adjust step for obtaining a member having a surface layer portion constructed by weak portions which are a solid, and high strength portion which have relatively higher strength than weak portions; and an inject step for injecting high pressure fluid to remove a part of the weak portions forming pits on the surface of the member after the member adjust step.

That is, by removing the weak portions of the member by injection of the high pressure fluid, the pits are formed on the surface.

The member adjust step adds the surface layer portion to the member. The surface layer portion is comprised of the weak portions and the high strength portion having relatively higher strength than the weak portions.

Thickness of the surface layer portion is not limited but preferably has value enough to secure for necessary depth of the pits. The surface layer portion is not necessarily provided on whole surface of the member but is sufficiently provided at least area where the pits are to be formed.

Material and shape of the weak portions and high strength portion are not limited. When the high pressure fluid is injected, the weak portions which are solid needs to be easily removed compared with the high strength portion.

For example, the weak portions can be comprised of material which is more fragile or softer than the high strength portion. In other case, the weak portions and the high strength portion can have an island-sea arrangement, so that the weak portions as the island can be easily removed from the continuous high strength portion as the sea. However, even when the island portions are constructed by substance having higher physical strength and continuous sea portion is constructed by substance having lower strength, if bonding between the sea portion and island portions is weaker than strength of the sea portions, the island portions are removed easily. In this case, the island portions having high physical strength constructs the weak portions, and the sea portion constructs the high strength portion. To the contrary, when the continuous sea portion has strength far lower than that of the island portions, the sea portion operates as the weak portions and the island portions are left as the surface layer portion of the member to operate as the high strength portion. Thus, the high strength portion of this embodying mode includes the portion not removed by the high pressure fluid treatment but is left on the surface layer portion of member integrally.

Figure 2:
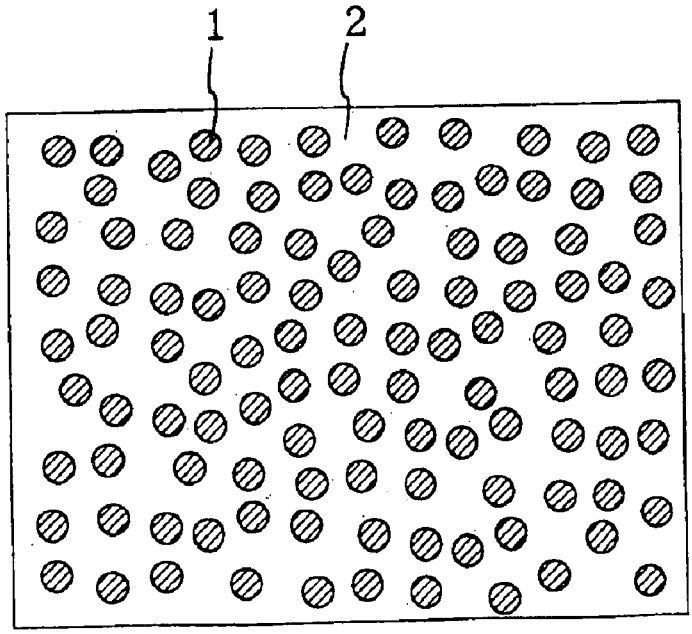
FIG. 2 is a figure showing other sample of a member surface adjusted by member adjust step of the present embodying mode.
Figure 3A:
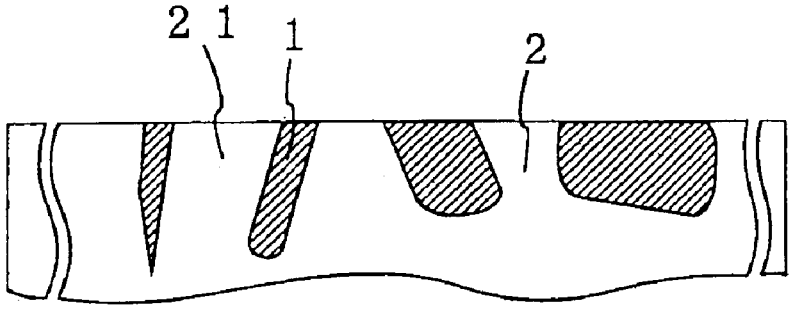
FIG. 3 is a figure showing change of cross section of member shown in FIG. 1 changing as proceeding of the inject step.
Figure 3B:
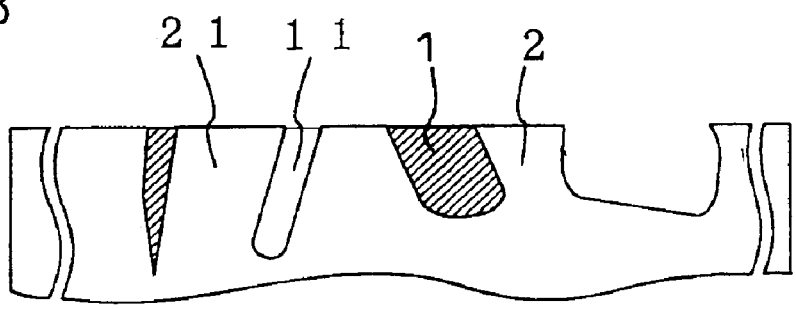
Figure 3C:
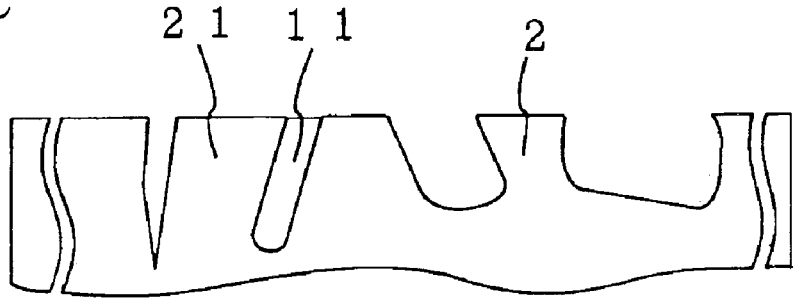
Figure 3D:
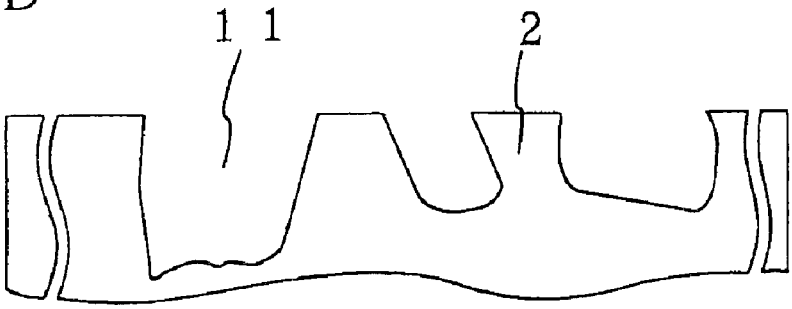

Individual shape of the weak portions is not limited. For example, it can have a flake shape, plate shape or fiber state shown in FIG. 1 or FIG. 3*a,* and can have a cubic shape or particle shape shown in FIG. 2. Among them, flake shape, plate shape and fiber state which have large aspect ratios are preferable for the weak portions 1. Removing such shapes of weak portions 1 can form the deep surface pits with smallest change of surface configuration of the member. The weak portions 1, as shown in FIG. 1, preferably surrounds a part of the high strength portion 2 to form an isolate portion 21 at part of the high strength portion 2. This isolate portion 21 is easily removed when the surrounding weak portions 1 is removed by injection of the high pressure fluid to form the larger pits to be explained later. For forming such isolate portion 21, many weak portions 1 can be formed on the surface layer portion to increase probability of the isolate portion being formed, or adjacent weak portions 1 are brought into closer relation in forming the surface layer portion by mutual operation between the weak portions 1. Further, when powders of same nature are dispersed and bonded by sintering and the like to make strength at the boundary surface portion becomes relatively weak (weak portions), the weak portions can hardly be removed by alone. Only the isolated portion surrounded by the weak portions may be removed by the high pressure fluid treatment.

The number and size of the weak portions 1 are changed corresponding to the number, size, and depth of the pits to be formed on the member surface layer portion finally. For example, provided that the inject step to be explained later are same, the member having larger total number of the weak portions will be formed larger number of the pits than the member having smaller total number of the weak portions.

The member having larger size of the weak portions 1 will be formed larger number and deeper depth of the pits totally than the member having smaller size of the weak portions 1.

For forming the weak portions 1 and the high strength portion 2, a flake graphite cast iron can be used as the member. In the flake graphite cast iron, the flake graphite particles are presented on the surface layer portion, and general iron base metal such as perlite as the high strength portion 2 fill gap. The member made of flake graphite cast iron can be adjusted by conventional casting method.

Other forming method for forming the surface layer portion having the weak portions 1 and high strength portion 2 can be a complex thermal spray or complex plating. That is, the surface layer portion can be formed by thermally spraying or plating materials becoming the weak portions 1 together with material becoming the high strength portion 2.

For example, iron, nickel, copper as the high strength portion 2, and resin such as polyester, graphite as the weak portions 1 can be used to form the surface layer portion. When the cylinder liner is formed, by mixing material becoming the weak portions 1 into molten material, the weak portions 1 is formed on the surface layer portion simultaneouly when material solidifies. For forming the surface layer portion having the weak portions 1 and high strength portion 2, the metal powders and ceramics powders are mixed and sintered, or the metal powders and ceramics powders are mixed and heated to dissolve the metal portion for integrating. The surface layer portion can be for example, PMC aluminum in which the aluminum alloy powders, ceramics powders and silicon particles are mixed and sintered, or MMC aluminum in which mullite particles and alumina-silica fiber are dispersed into aluminum base.

Simultaneous with the member adjust step, or between the member adjust step and inject step, a surface flatten step for the surface layer portion can be provided. The surface flatten step flattens the surface in grinding or in forming the surface layer portion. In the inject step to be explained later, the portions of surface layer portion other than the weak portions 1 are not influenced by injection of the high pressure fluid, flatness can be maintained even if the surface flatten step is performed before the inject step. If the surface flatten step is performed after the inject step having formed the pits, edge of the pits and surface formed are removed, so that flatness may be decrease, and grinding material used for grinding may be entered into the pits. However, even when the surface flatten step is performed after the inject step, the pits formed by forming method of the embodying mode have enough depth not to be removed easily by the grinding.

The inject step injects the high pressure fluid to remove at least a part of the weak portions 1 for forming the pits.

In the inject step, in addition to the weak portions 1, the high strength portion 2 can be removed within range all of the surface portion of the member surface layer portion being not removed.

The high pressure fluid is injected to the portion of the member where the pits are to be formed, for example, to a part of the surface layer portion. The high pressure fluid can be injected to the whole member at once, or to local areas repeatedly.

In this embodying mode, the injection step is performed to an inner surface of a cylindrical cylinder liner. So, a nozzle for high pressure fluid is set to the rotating nozzle body to make a predetermined angle relative to rotation axis, being moved along the rotation axis with rotating the nozzle body. The nozzle for high pressure fluid is preferably set in axis-symmetry relative to the rotation axis so that the rotation axis is not vibrated by injection of the high pressure fluid. When the inject step is applied to the member other than cylindrical shape, the high pressure fluid is preferably injected by a high pressure fluid inject apparatus which can form the pits on the surface without unevenness along shape of the surface on which the surface pits are to be formed.

An inject pressure of the high pressure fluid changes depending on material of the member, and materials of the weak portions 1 and high strength portion 2 both forming the member surface layer portion.

For removing the weak portions 1, force exceeding bonding force between each weak portions 1 and high strength portion 2 is needed. Accordingly, the inject pressure of the high pressure fluid capable of exceeding a bonding force between the weak portions 1 and high strength portion 2 is needed. Value of the inject pressure which can remove all of the weak portions 1 presented on the surface layer portion is not necessary, but value of pressure capable of removing at least a part of the weak portions 1 is enough. To the contrary, the inject pressure of value higher than pressure necessary for removing the weak portions 1 can remove, in addition to the weak portions 1, the high strength portion 2 adjacent to the weak portions 1. Additional removing the high strength portion 2 can form larger surface pits on the member surface layer portion.

For example, when the pits are formed on the member made of piece shape graphite cast iron, the weak portions 1 (piece shape graphite) on the member surface layer portion begins to be removed in pressure of 170 MPa. In the pressure of 240 MPa, also the high strength portion 2 adjacent to the weak portions 1 begin to be removed.

Also, in the forming method of surface pit of this embodying mode, since removal of the weak portions 1 presented on the surface layer portion by the high pressure fluid proceeds depending on probability. As the result, as the inject time of high pressure fluid becomes longer, total number of pits to be formed increases.

The number and size of the surface pits formed on the member can be controlled by changing the inject pressure and inject time of the high pressure fluid. For example, assumed that the members comprised of same surface layer portion are used, if the inject pressure is changed with maintaining the inject time constant, the pressure fluid of higher inject pressure can remove larger weak portions 1 and high strength portion 2 adjacent thereto. Thus larger, deeper and more pits can be formed. Also, when the inject time is changed with maintaining the inject pressure constant, size and depth of the pits formed is not changed largely since the same inject pressure removes substantially same weak portions 1 and high strength portion 2. However, as the injection time becomes longer, the total number of the pits to be formed on the member finally increases.

When the large number of small and shallow pits are desired to be formed on the member surface layer portion, the inject time is sufficiently set longer with setting the inject pressure relatively lower. When the small number of large and deep pits are desired to be formed on the member surface layer portion, the inject time is sufficiently set shorter with setting the inject pressure higher.

For example, by injecting the high pressure fluid to the member shown in FIG. 1, the weak portions 1 in the surface layer portion shown in FIG. 3(*a*) are removed as shown in FIG. 3(*b*), to form the pits 11. In this case, by setting the inject pressure more higher or the inject time more longer, all of the weak portions 1 can be removed as shown in FIG. 3(*c*). With increase of inject pressure of the high pressure fluid, as shown in FIG. 3(*d*), the large pits 11 are formed at surroundings of the isolate portion 21 surrounded by the weak portions 1. Thus, the isolated portions 21 are removed finally to form the pits 11.

Generally, the minimum value of inject pressure necessary for removal of the high strength portion 2 adjacent to the weak portions 1 is smaller than the maximum value of inject pressure necessary for removal of the weak portions 1. For this reason, for formation of the pits 11 having necessary number, size and depth, the inject pressure, inject time of the high pressure fluid must be controlled suitably.

The high pressure fluid of inject pressure not removing the isolated portions acts only to surrounding of the weak portions 1 such as graphite, which is convenient to remove a burr around the weak portions.

The substance of the high pressure fluid can be selected in view of the number, size and depth of the surface pits 11 to be formed. The high pressure fluid can be a liquid such as a water or an oil, and can be mixture in which fine powders such as a garnet powders and glass beads are mixed into the liquid. The high pressure fluid can be fine powders particles. Also, additive such as rust prevent agent can be mixed depending on nature of the member as the member to be processed.

The high pressure fluid is not necessarily substance which is liquid in the normal temperature, but can be liquified gas such as liquid carbonic acid or liquid nitrogen. Such liquified gas of generally low temperature cools the member the high pressure fluid being injected make it fragile. Thus, forming efficient of the pits may be increased.

The liquified carbonic acid, being discharged in high pressure under normal pressure atmosphere, creates fine powders of solidified carbonic acid. The solidified carbonic acid fine powders collide to the weak portions 1 of the member surface layer portion, having large removing ability of the weak portions 1. Due to curburetion and diffusion of the solidified carbonic acid collided to the weak portions 1 from the member surface, no post treatment is needed. This merit can be obtained in other liquified gas.

<Member with Surface Pits>

In the following, various embodying modes of the member having the surface pits will be explained in detail. However, it is noted the present invention is not limited to these embodying modes.

The member having the surface pits of the present embodying mode will be explained as to the cylinder liner of automobile engine, similar to the forming method mentioned as above. Another member having surface pits to which the present invention is applied can be a member having slide surface sliding between the members. They can be surface of a cylinder bore, a cylinder liner and cylinder bore of an engine other than automobile, a cylinder bore and cylinder liner of a compressor, or a swash plate or shoe of swash- plate fashion volume-variable type compressor. Also, a member necessitating to hold a lubricant agent on the surface continuously can be included. Material of the member having the surface pits is not restricted, but can include a metal material such as iron base material or resin. When the member having the surface pits of the present embodying mode has such slide surface, holding the lubricant agent in the pits can increase the oil holding character on the slide surface to prevent baking of the slide surface.

The member having the surface pits of the present embodying mode has the pits formed by removing the parts of the weak portions by injection of the high pressure fluid.

The member having surface pits of the present embodying mode, being removed part of the surface layer portion selectively by injection of the high pressure fluid, has the pits on the surface with maintaining original surface configuration of other part. The pits formed on the surface layer portion can be formed in range so that all of the surface layer portion are not removed.

The member having such surface pits can be obtained by applying the forming method of the surface pits mentioned above to the member on which the surface pits are to be formed.

An average value of distance between the pits preferably ranges from 20 times to 200 times of the average value of pits depth, and more preferably it ranges from 100 times to 200 times of the average value of pit depth. When the average distance between the pits is smaller than this value, surface roughness of the member surface become larger to suddenly increase friction coefficient. To the contrary, the average distance between the pits is larger than pits value, effect of the pits as the oil storage becomes relatively smaller to cause scuff due to oil shortage. For obtaining the average value of distance between the pits, roughness curve is measured by the measure distance 20 mm, to calculate average distance of the pits in the data. As depth of the pits used in this calculation, depth more than 30% of roughness value by Rz indication is used (for example, when roughness value is 10 $\mu$mRz, only the pits having depth more than 3 $\mu$m are used for calculation). The average value of distance between the pits can be changed by adjusting density of the portions (weak portions) to be removed by the high pressure fluid treatment.

By injecting the high pressure fluid partially, the portions injected by the high pressure fluid (portions the pits being formed) can be made intermittent. For partial injection of the high pressure fluid, treating area of the surface layer portion can be masked by the mask member, or the high pressure fluid is reduced for the small area treatment. In this case, average value of length of the portion not subjected to injection of the high pressure fluid is preferably more than average value of length of the portion subjected to injection of high pressure fluid, and preferably ranges from 20 times to 200 times of the average value of the pit length. Ranging 100 times to 200 times of the average value of pits depth is more preferable. When the average value of length of the portion not subjected to the injection of the high pressure fluid is smaller than that of the portion subjected to the injection of high pressure fluid, influence of distance between the pits in the portion subjected to the injection of the high pressure fluid becomes relatively larger. When average value of length of the portion not subjected to injection of the high fluid pressure is smaller than 20 to 200 times of average value of pit depth, the surface roughness of the member surface becomes larger 20 to 200 times of to suddenly increase friction coefficient.

To the contrary, when it is larger than the average value of the pit depth, effect of the pits as the oil storage becomes relatively small to occur scuff due to oil shortage. For obtaining average value of length of the portion not subjected to injection of the high pressure fluid the roughness curve is measured by measure distance of 20 mm in slide direction in which the member having the pits of the present embodying mode slides, to calculate average distance of the portion the pits being not formed in the data. For obtaining average value of length of the portion subjected to injection of the high pressure fluid, the roughness curve is measured by the measure distance of 20 mm to calculate the average distance between the pits in the data. As the pit depth used here, depth more than 30% of roughness value of Rz indication is used.

The member having the surface pits is preferably made of flake graphite cast iron, and the pits are preferably formed by graphite particles removed. This is because the pits of the flake graphite cast iron can be easily controlled. Also, the pits can be the removed portion where matrix portions such as the perlite filling gap of the graphite particles are removed, in addition to removed portion the graphite particles being removed.

The member having the surface pits can be the PMC aluminum in which aluminum alloy powders, ceramics powders and silicone particles are mixed and sintered, or the MMC aluminum in which mullite particles and alumina-silica fibers are dispersed in aluminum base. The PMC aluminum and MMC aluminum have excellent mechanical quality such as strength. Also, existing ratio of the weak portions and high strength portion can be easily controlled by changing mixing rate of the composition material (aluminum alloy powders, ceramics powders and silicone particles for PMC aluminum, aluminum base, mullite a particles, aluminum-silica fiber for MMC aluminum).

Surface having the pits of the member having the surface pits is preferably flat, because flat surface is preferable in using the member as the slide member. The surface pits preferably have small area compared with the surface portion and large depth.

(Embodiments)

Hereinafter, the present invention will be explained concretely based on embodiments.

(Embodiments 1 to 4, Comparative samples 1 and 2)

In the embodiments and comparative samples, surface pits are formed on an inner surface of a cylinder bore (internal diameter is 86 mm) made of piece shape graphite cast iron (FC 230).

<Forming method of Surface pits>

Figure 4:
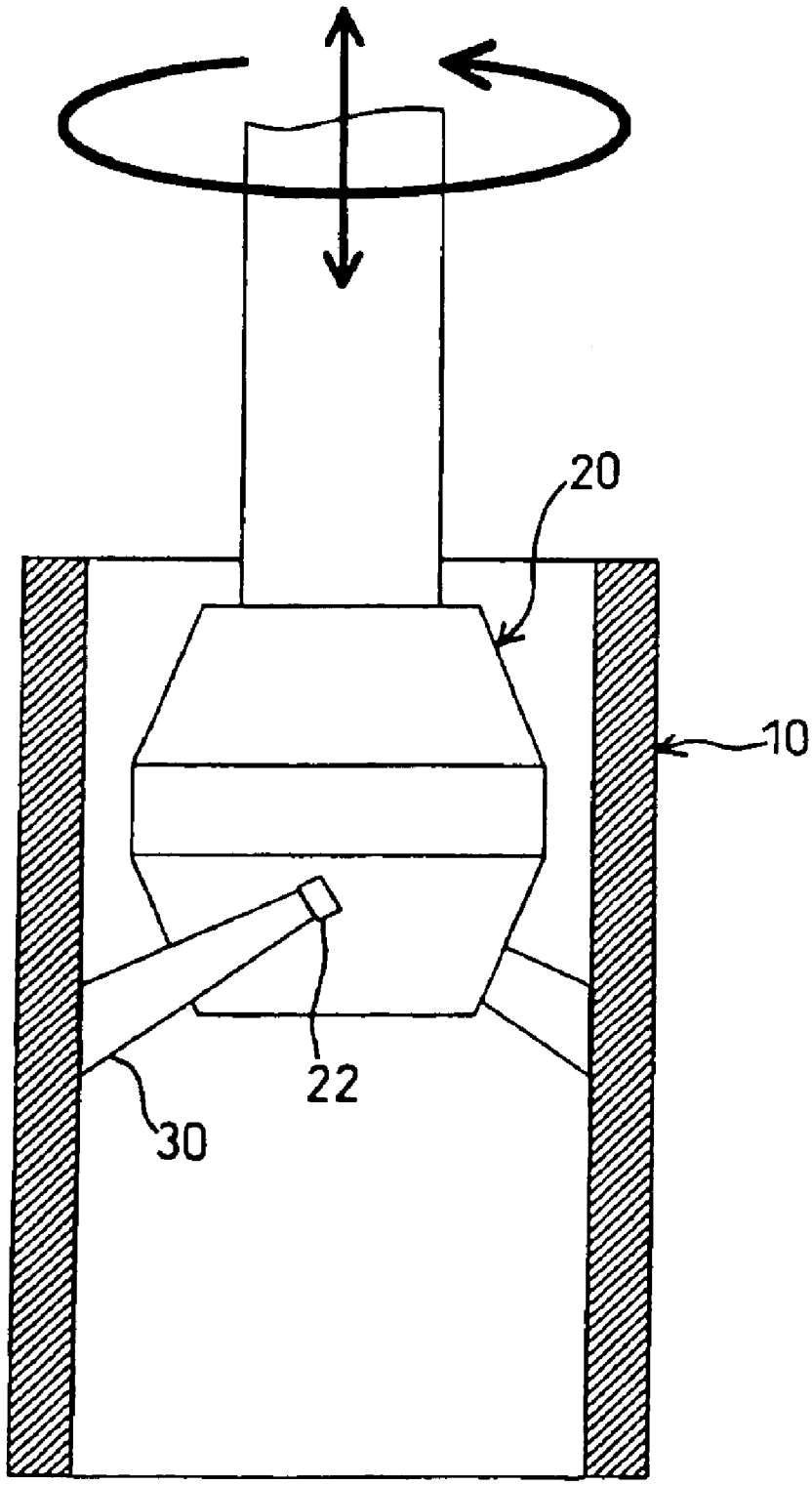
FIG. 4 is a figure showing an inject apparatus performing high pressure water injection of embodiments.

Water as the high pressure fluid is injected to the inner surface of the cylinder bore by an apparatus shown in FIG. 4. In the apparatus, a nozzle body 20 having a high pressure water inject nozzle 22 is disposed inside of the cylinder bore 10. With injecting the high pressure water 30 (water) of various inject pressure to the inner surface of the cylinder bore 10, the nozzle body 20 is rotated and moved along a rotating axis. Gap between the high pressure water inject nozzle 22 and the inner surface of the cylinder bore is 10 mm. Rotating speed of the nozzle body 20 is 650 rotations/min., and moving speed of the nozzle body 20 in the rotation axis direction is 5 mm/sec. Treatment is performed once in these conditions. The cylinder bores 10 obtained by high pressure water injection of various pressure are used as test specimens of the embodiment 1.

Test specimens of the embodiment 2 are obtained by setting inject pressure of the high pressure water in 270 MPa, and changing moving speed of the nozzle body 20 in the rotation axis direction.

In both of the embodiments 1 and 2, surface hardness of the test specimen is about Hv 220.

Test specimen of the embodiment 3 is prepared by injecting high pressure water (280 MPa, moving speed of nozzle body is 5 mm/sec.) to a linear inner surface of an aluminum engine(discharge amount is 500 ml) having a cylinder liner made of FC 230 of single cylinder. Test specimen of comparative sample 1 is prepared by aluminum engine not treated.

Test specimen of the embodiment 4 is prepared by injecting the high pressure water to the surface of FC 230 having disc configuration. High pressure water is injected in 300 MPa with changing moving speed of the high pressure water inject nozzle.

<Surface oil contain amount on Inner surface of cylinder bore>

A surface oil contain amount of test specimens of embodiment 1 and 2 are measured. For calculating the surface oil contain amount, the inner surface of the cylinder bore 10 is dipped into the engine oil (5W-30) of 150° C. in 60 sec., and then the surface is scraped by cotton cloth. Oil contain amount per unit area is calculated from weight change before and after scraping.

<Measurement of surface roughness>

Surface roughness of each test specimen of the embodiment 2 is measured. As indication for roughness Rk and Rvk are used. Rk is indication mainly representing surface roughness of the terrace portion, while Rvk is indication mainly representing the surface roughness of surface pits portion. Rk and Rvk can be calculated by a relative load curve (BC) calculated from the special roughness curve in turn calculated from the cross section curve.

In determining Rk, the BC curve is surrounded by 40% width of the relative load length (tp) to determined two points located at both ends and have the smallest depth difference. An approximate curve is determined by the least-squares method based on curve portion located between the two points. When crossed points among extended line of the linear line, 0% limit line and 100% limit line are named A point and B point, Rk can be determined by depth difference between the A point and the B point.

In determining Rvk, when crossed point between a horizontal line from B point and BC curve is named D point, value of area surrounded by line segment BD, BC curve and 100% limit line is calculated. In the right triangle having the same value of area as the above the surrounded area, Rvk can be calculated as altitude when line segment BD forms the base.

The cross section curve of each test specimen of the embodiment 2 is measured by "surfcorder SE-3400" manufactured by Kosaka Laboratory.

The special roughness curve is determined based on the cross section curve in the following manner. In the first, the cross section curve is flattened (ISO Gaussian filter) to determine a swell curve. The swell curve and the cross section curve are compared to determine the cross section curve. When the cross section curve is higher than the first swell curve, a curve line connecting the first swell curves is determined. To the contrary, when the cross section curve is lower than the first swell curve, a curve line connecting the first swell lines is determined. Thus determined curve is flattened to determined the second swell curve. The special roughness curve is determined by subtracting the second swell curve from the cross section curve.

The relative load curve is determined by arranging the special roughness curve in order to higher portion to lower portion.

<Surface Observation>

Surface of the test specimen of the embodiment 2 is observed by metal microscope.

<Motoring Test>

A motoring test is performed in the following condition by using the aluminum engine of the embodiment 3 and the aluminum engine of the comparative sample 1.

Number of rotation: some number of rotation in range 800 to 3000 rpm

Test time: 15 min. per each number of rotation

Oil temperature: 60° C., 80° C., 100° C. and 120° C.

Water temperature: 60° C., 80° C., 100° C. and 120° C.

(Surface Friction Endurance Test)

In surface friction endurance test, the test specimen of the embodiment 4 is sprayed an oil (5W-30) on the surface where the pits are formed, and is rotated by 300 rpm.

A cut piece prepared by cutting the nitride piston ring into 5 mm length is pressed to portion on the surface spaced by distance of 10 mm from rotation center so that Hertz stress becomes 30 MPa. Same test is performed for the specimen not subjected to the high pressure water inject treatment to obtain the comparative sample 2. Friction coefficient of surface of the test specimens of embodiment 4 and the comparative sample 2 having been tested are measured.

<Test Result>

Figure 5:
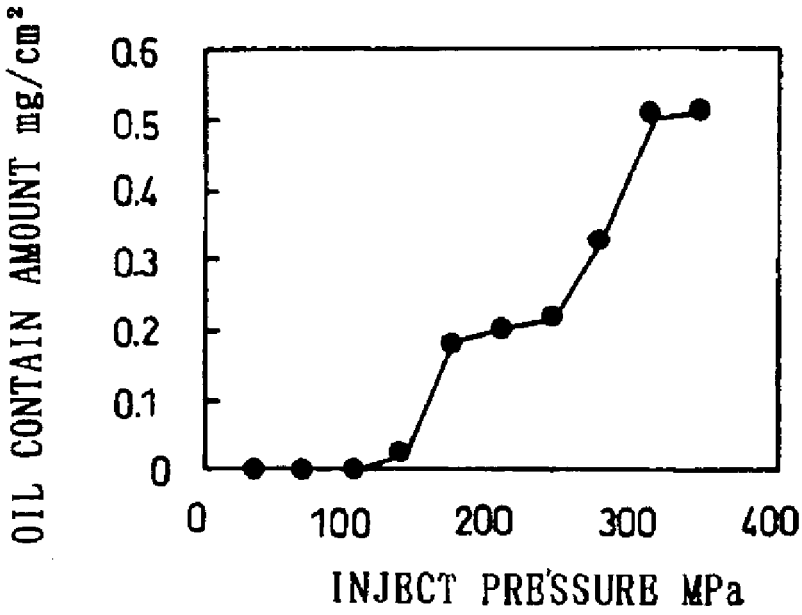
FIG. 5 is a figure showing relation between an inject pressure and a surface oil contain amount of the embodiment 1.

Test result of the surface oil contain amount of the test specimen of the embodiment 1 is shown in FIG. 5. As apparent from it, the surface oil contain amount increases when the inject pressure is set higher than 140 MPa, further increasing when the inject pressure is set higher than 240 MPa.

Figure 6:
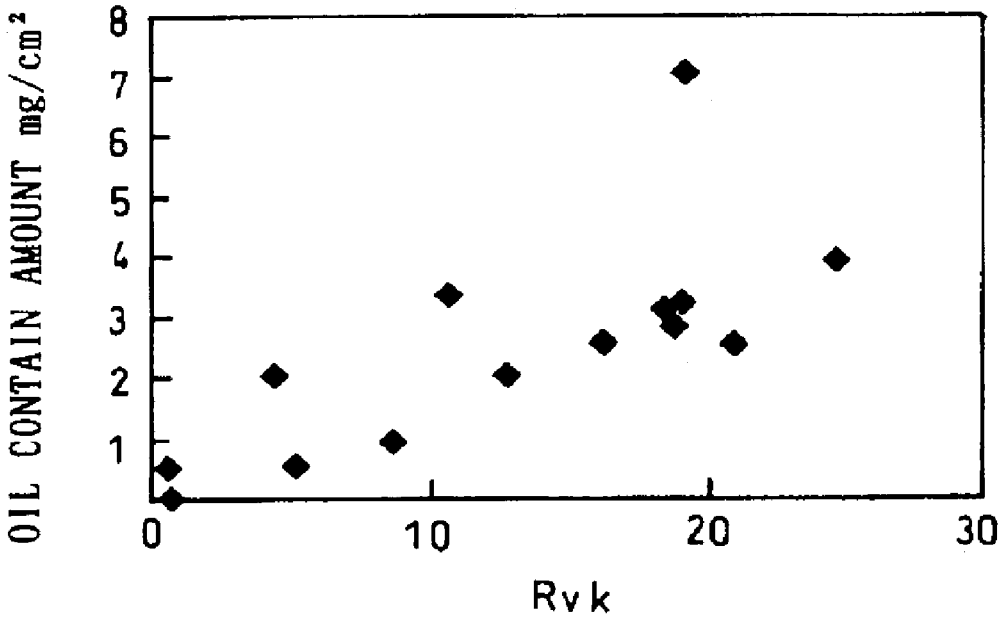
FIG. 6 is a figure showing relation between Rvk and a surface oil contain amount of an embodiment 2.

Relation between the surface oil contain amount and Rvk of the test specimen of embodiment 2 is shown in FIG. 6. As apparent from it, the surface oil contain amount and Rvk have good interact relation, and as Rvk become higher the surface oil contain amount increases. Depth of the pits is constant even when value of Rvk become higher. Constant depth seems to be resulted from constant inject pressure of the high pressure water. For this reason, value of Rvk shown here do not represent increase of pit depth, but represents increase of total number of the pits.

Figure 7A:
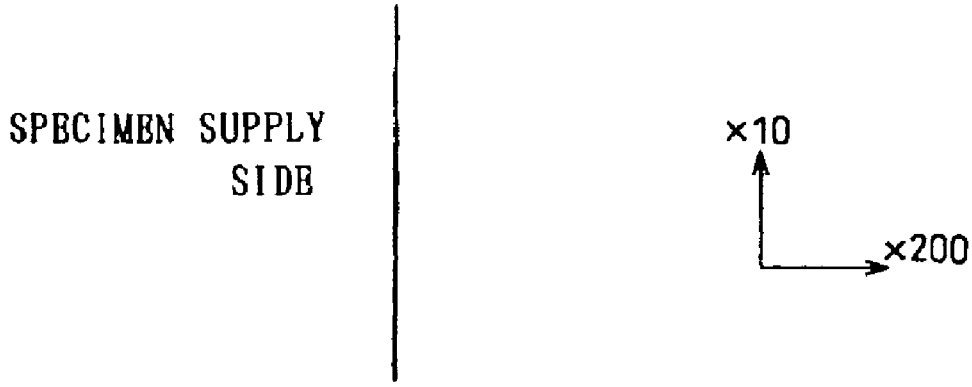
FIG. 7 is a figure showing one sample of cross section curve of the embodiment 2.
Figure 7B:
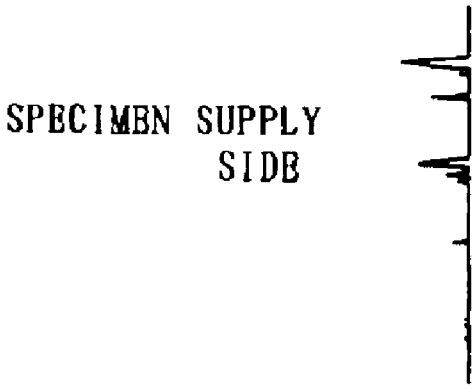
Figure 8:
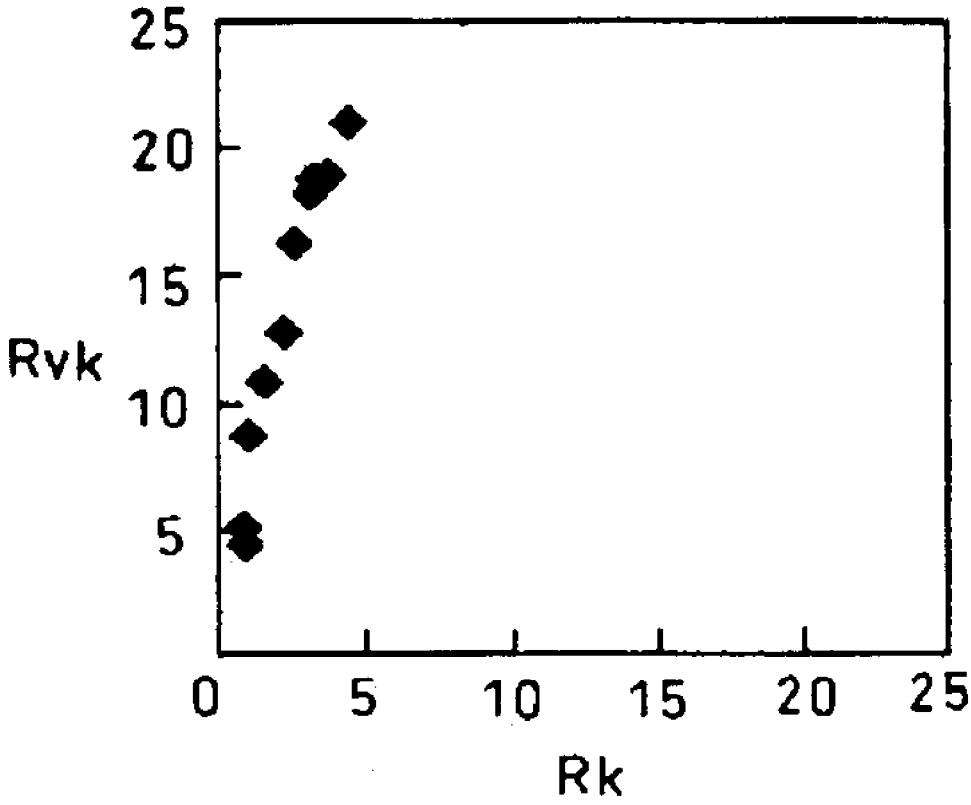
FIG. 8 is a figure showing relation between Rk and Rvk of the embodiment 2.

One sample of the cross section of the embodiment 2 is shown in FIG. 7, and relation between the Rk and Rvk of it is shown in FIG. 8. FIG. 7(*a*) shows the cross section curve of the test specimen prior to the high pressure water injection, and FIG. 7(*b*) shows that of post the high pressure water injection. As apparent these figures, the surface roughness of portions other than the pit portions are not increased in spite of increase of Rvk, that is increase of total number of the pits.

Figure 9B:
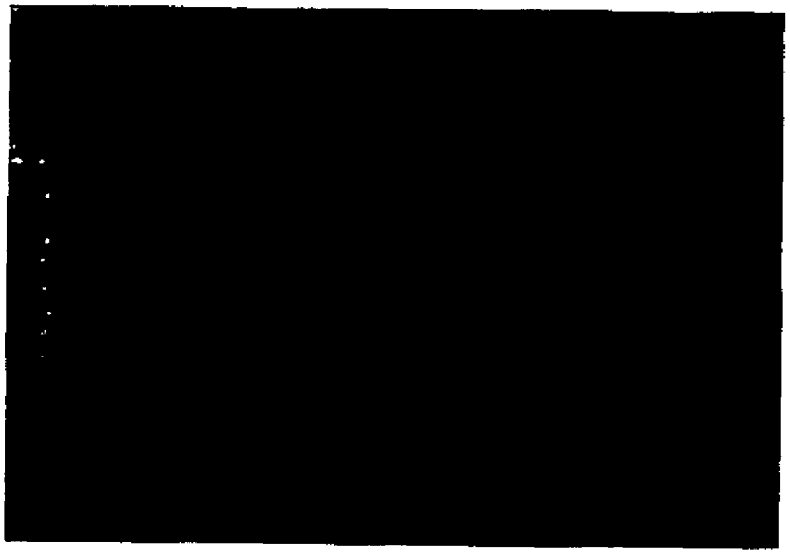
FIG. 9 is a microscope photograph of surface of test specimen of the embodiment 2.
Figure 9A:
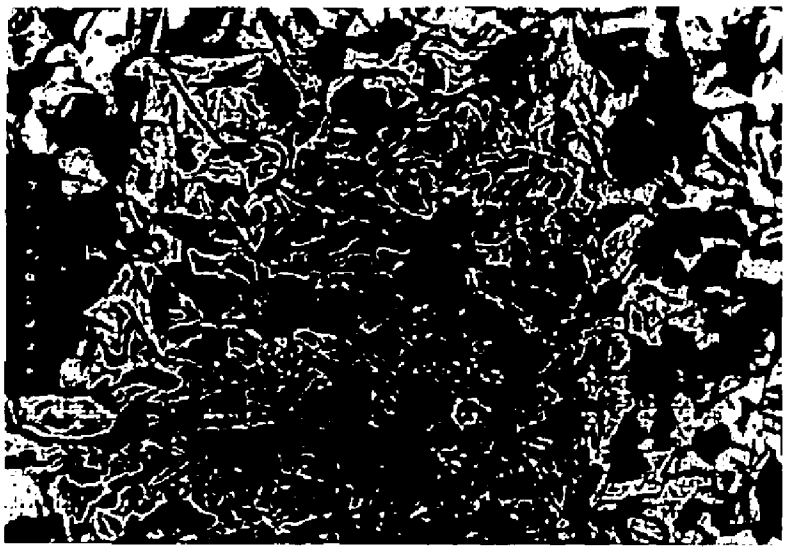

As result of surface observation of the test specimen piece of the embodiment 2, the graphite particles being removed as shown in FIG. 9 is confirmed.

As result of the motoring test, decrease of friction by 3.2% is confirmed, which corresponds to decrease of mileage by 1.5%.

Figure 10:
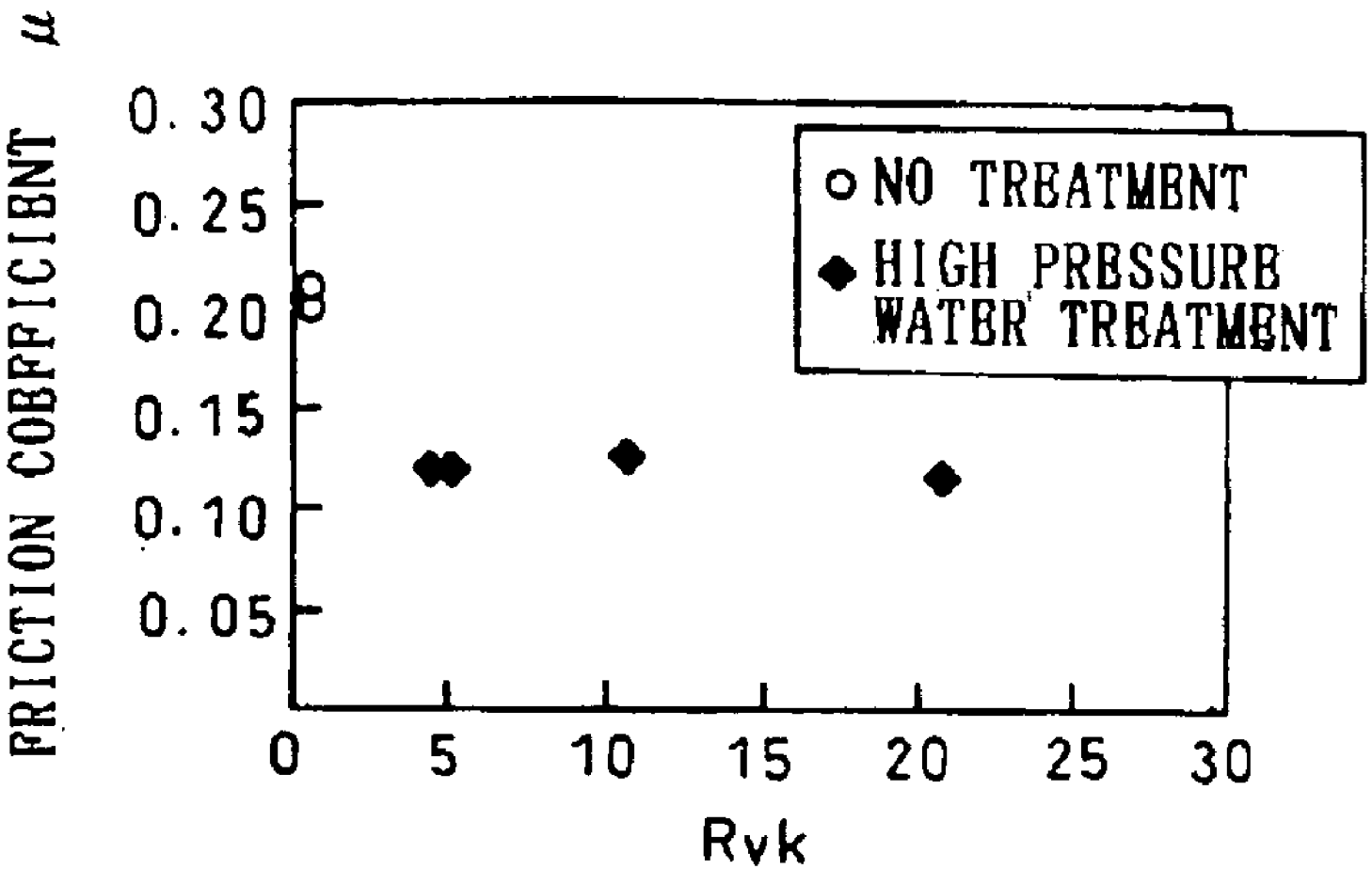
FIG. 10 is a figure showing relation between Rvk and endurance of surface friction coefficient of the embodiment 4.

Result of the surface friction endurance test is shown in FIG. 10. As apparent from it, all of the specimens subjected to the high pressure water treatment have low friction coefficient irrespective of value of Rvk.

(Embodiments 5 to 11, Comparative sample 3 to 6)

<Measuring method for Surface roughness>

In the embodiment 5 to 11 and comparative samples 3 to 6, Rz is used as indication to represent to the surface roughness. In determining Rz, a standard length (0.25 mm) of the roughness curve is cut in direction of the average line, and measured in direction of vertical magnification from the average line of this cut portion. Sum of average of absolute values of the highest peak (Yp) to the fifth highest peak, and average of the absolute values of the lowest valley (Yv) to the fifth lowest valley is calculated and shown by micrometer ($\mu$m). In the present specification, the surface roughness is shown by the maximum value of Rz allowable. For example, 0.5 Rz means the average of value of some Rz optionally extracted from the designated surface is larger than 0 $\mu$m Rz and smaller than 0.5 $\mu$m Rz.

<High pressure water treating method>

The water as the high pressure fluid is injected to the inner surface of the cylinder bore by the apparatus shown in FIG. 4, similar to the embodiment 1 to 4. That is, the nozzle body 20 having the high pressure water inject nozzle 21 is arranged inside of the cylinder bore 10. The nozzle body 20 is rotated with injecting the high pressure water (water) 30 of various inject pressures to the inner surface of the cylinder bore and is moved in the axis direction. Gap between the high pressure water inject nozzle 21 and the inner surface of the cylinder bore is set in 10 mm. The treating condition such as rotating speed of the nozzle body 20, nozzle moving speed in the rotation axis of the nozzle body 20, and the inject pressure of the high pressure water are changed for each test specimen.

<Test specimen>

(Embodiment 5)

(Pits formation)

1. After balling the inner surface of the cast iron liner (FC 230), honing process is performed. Surface roughness of the honing finish is smaller 0.5 Rz.

2. The FC liner is subjected to the high pressure water treatment. As the treating conditions, inject pressure of the high pressure water is 280 Mpa, rotating speed of the nozzle is 650 rpm, and moving speed of the nozzle is 30 mm/sec.

(Surface condition)

Figure 11:
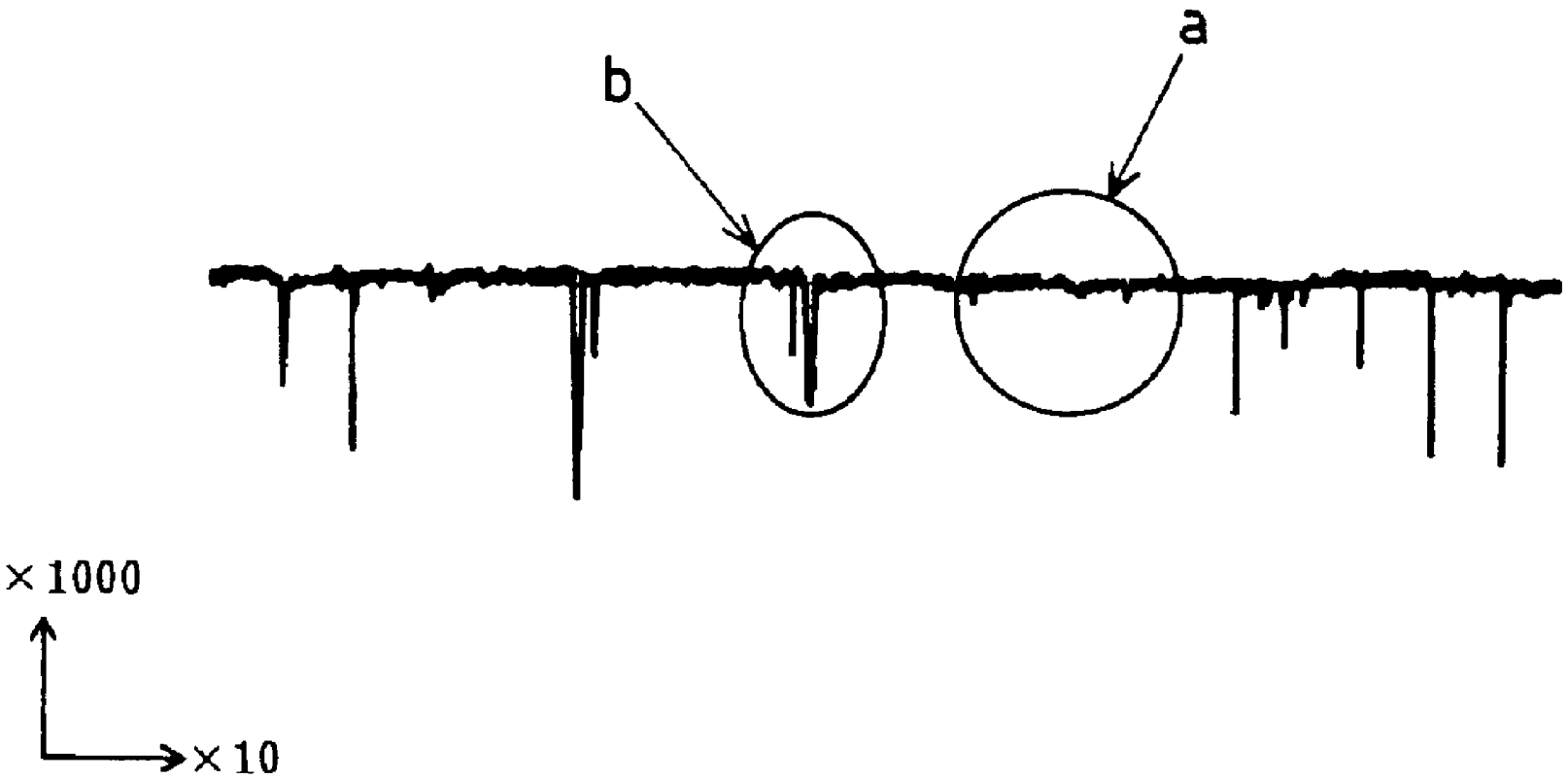
FIG. 11 is a figure showing one sample of cross section curve of the embodiment 5.

The surface having cross section character (roughness curve) as shown in FIG. 11 is obtained. Although surface roughness of 0.3 $\mu$mRz of the surface of the terrace portion is very small and equivalent to that of the mirror surface, the pits portions b have the average depth of 5 $\mu$m. That is, the pits having sharp peak can be formed without influencing the surface roughness of the surface.

By applying forming method of surface pits according to the present invention, the surface in which the flat terrace portion and the pit portion are mixed can be obtained. Such surface the portions of different strength being mixed can be realized by the following reason. The portions of the member to be treated having relatively strong strength (high strength portion; mainly cementite and perlite portion) are not influenced by high injection of the high pressure water, but the portion having strength smaller than shock force of the high pressure water (weak portions; mainly piece shape graphite portion) are removed or formed into concave to form the pits.

Figure 12:
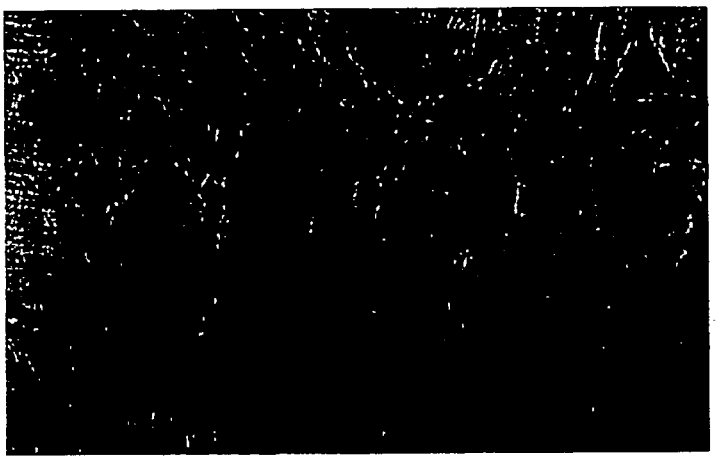
FIG. 12 is a figure of surface of test specimen of the embodiment 5 observed by a microscope.

In embodiment 5, as shown in FIG. 12, in addition to the flake graphite, a part (isolate portion) of the matrix made of perlite and cementite and surrounded by the flake graphite (high strength portion) is removed to form the pits.

(Embodiment 6)

(Pit Formation)

1. After balling the inner surface of the cast iron liner (FC 230), honing process is performed. Surface roughness of the honing finish is smaller 0.5 Rz.

2. The FC liner is subjected to the high pressure water treatment. As the treating conditions, inject pressure of the high pressure water is 150 MPa, rotation of the nozzle is 650 rpm, and moving speed of the nozzle is 2 mm/sec. (forward), and 30 mm/sec. (backward).

(Surface Condition)

Figure 13:
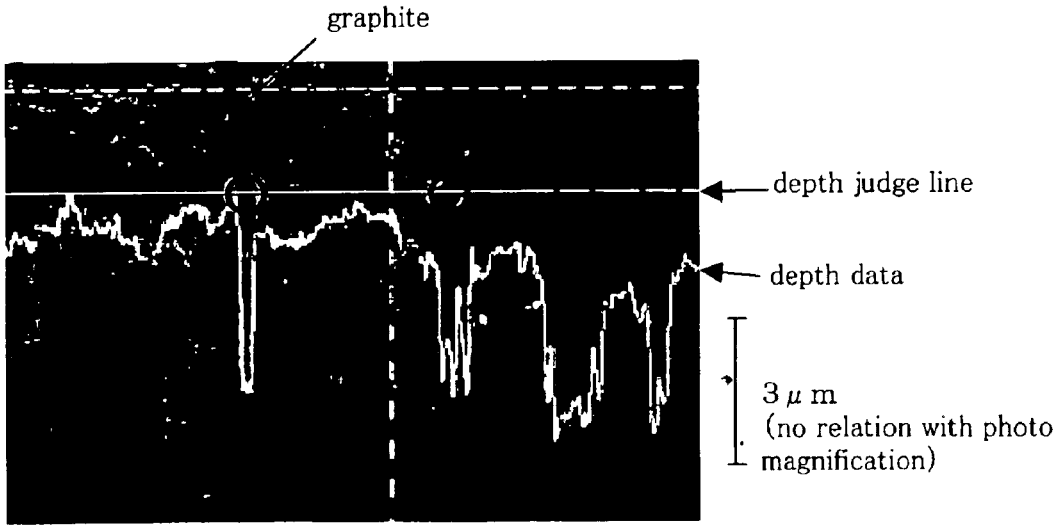
FIG. 13 is a figure and cross section curve of surface of test specimen observed by a microscope.

In the embodiment 6, lowering inject pressure of the high pressure water compared with that of the embodiment 5 removes only the graphite portion (weak portions) without removing the isolate portion (FIG. 13). The surface has surface roughness of 0.5 $\mu$mRz at the terrace portion which is equivalent to that of the mirror surface, having average depth of 3 $\mu$m at the pit portion similar to the embodiment 5.

The moving speed in the backward movement (30 mm/sec.) is selected faster than that (2 mm/sec.) in the forward movement in the high pressure water treatment. Slow processing speed of 2 mm/sec. generates red rust on the surface to be treated in the treating. High processing speed of 30 mm/sec. backward movement is selected to avoid occurrence of red rust.

(Embodiment 7)

(Pit formation)

1. After balling the inner surface of the aluminum liner made of PMC (powders metal composit), the forming process is performed. Surface roughness of honing finish is smaller than 0.4 Rz. In the PMC aluminum, the aluminum alloy powders, ceramics powders and silicone particles are mixed in the dispersed condition as the sintered body. It include the aluminum alloy portion as the weak portions of low strength, and the ceramics powders and silicone particles as the high strength portion of relatively high strength.

2. The PMC aluminum liner is subjected to the high pressure water treatment. As the treating condition, inject pressure of the high pressure water is 280 MPa, rotating speed of the nozzle is 650 rpm, and moving speed of the nozzle is 5 mm/sec.

(Surface Condition)

Figure 14:
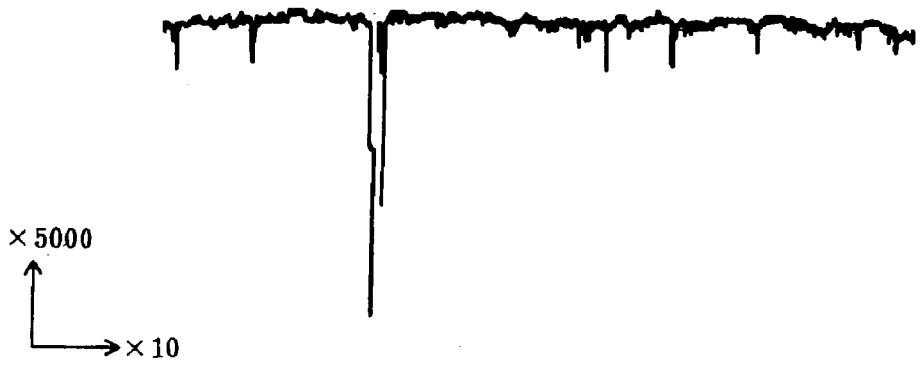
FIG. 14 is a figure showing one sample of cross section curve of the embodiment 7.

By removing the weak portions by the high pressure water treatment as shown in cross section view of FIG. 14, the pits having the sharp peak formed without influencing surface roughness of the surface.

Accordingly, the surface layer portion of the member to be processed is not limited to the cast iron, but can include the surface where portion of the high strength (high strength portion) and the portion of the low strength (weak portions) are mixed, irrespective of material thereof.

(Embodiment 8)

(Pit Formation)

1. After balling the inner surface of the bore of cylinder block made of MMC (metal matrix composit), honing process is performed. The surface roughness of the honing finish is set smaller than 0.5 Rz. In the MMC, the mullite particles and alumina-silica fibers (high strength portion) are dispersed in the aluminum base (weak portions).

2. The bore made of MMC is subjected to the high pressure water treatment. As the treating condition, the inject pressure of high pressure water is 200 MPa, rotating speed of nozzle is 650 rpm and moving speed of the nozzle is 20 mm/sec.

(Surface Condition)

Figure 15:
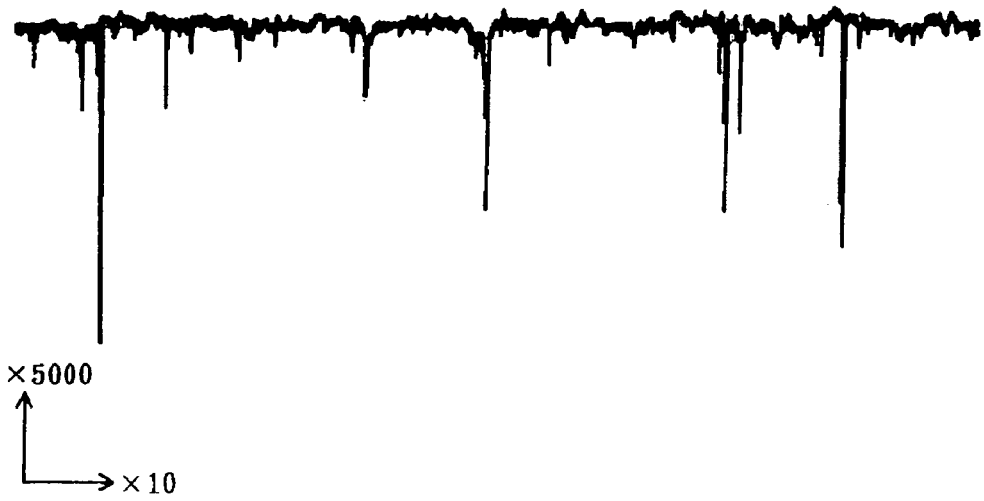
FIG. 15 is a figure showing one sample of cross section curve of the embodiment 8.

By removing the weak portions by the high pressure water treatment, as shown in the cross section of FIG. 15, the pits having the sharp peaks are formed without largely influencing surface roughness of the surface. These pits are formed by the removed portions of the aluminum base. Accordingly, it becomes apparent that the weak portions of the surface layer portion of the member to be processed can be the portion where the continuous matrix is to be formed, as long as they are easily removed than the other portions.

(Embodiment 9)

(Pit Formation)

1. After balling the inner surface of the liner made of cast iron (FC 230), the honing process is performed Surface roughness of the honing finish is smaller than 0.5 Rz.

Figure 16B:
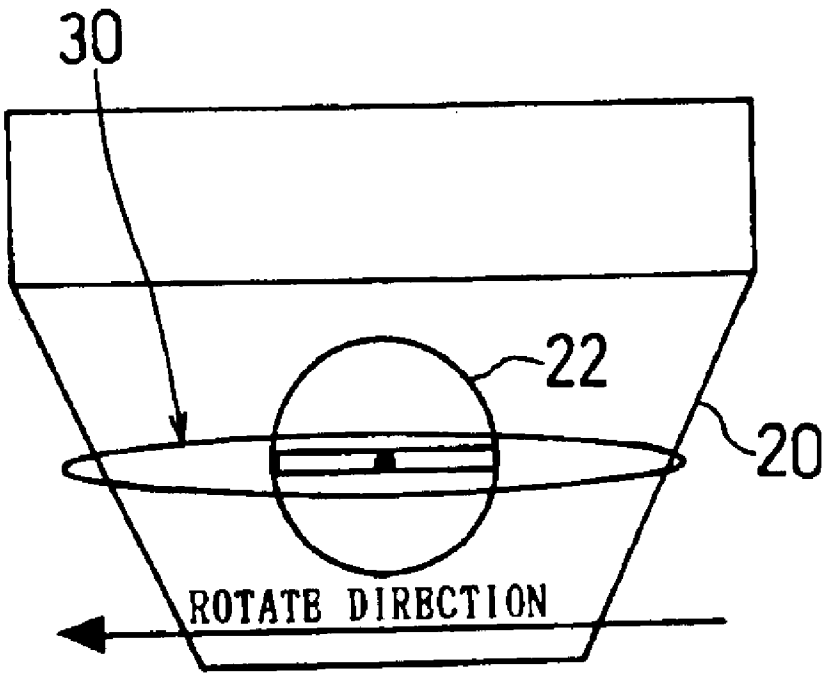
FIG. 16 is a model figure showing high pressure water inject nozzlel used in the embodiments 9 and 10.
Figure 16A:
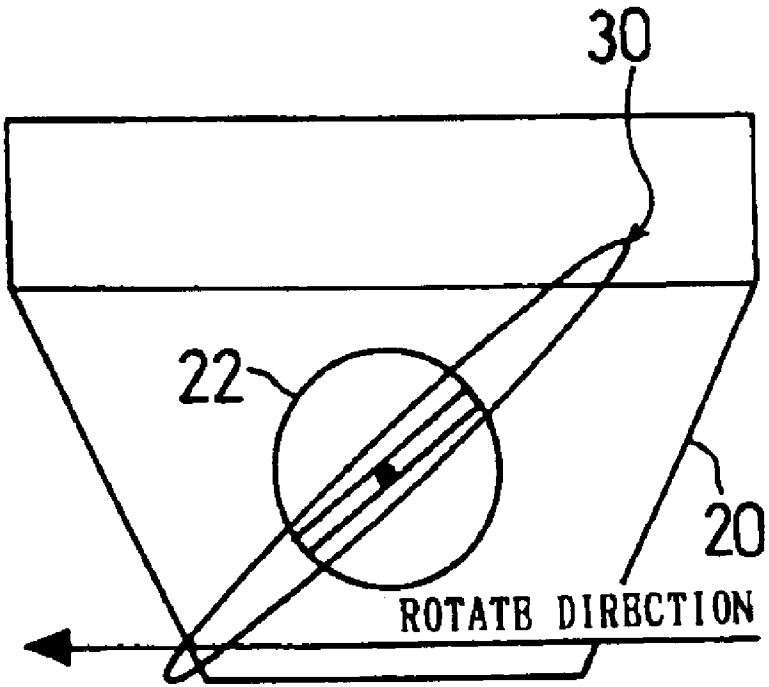

2. In the other embodiment as shown in FIG. 16(*a*), the nozzle injecting the high pressure water is held oblique relative to the rotation direction, and the high pressure water 30 is injected to the surface of the member to be processed constantly. However, in this embodiment as shown in FIG. 16(*b*), outlet of the nozzle made into thin line is coincided with the rotation advance direction so that the treating width of the member to be processed becomes smaller than 0.1 mm.

3. The FC liner is subjected to the high pressure water treatment. As the treating condition, the inject pressure of the high pressure water is 280 MPa, rotating speed of the nozzle is 650 rpm, and moving speed of the nozzle is 30 mm/sec.

(Surface condition)

Figure 17:
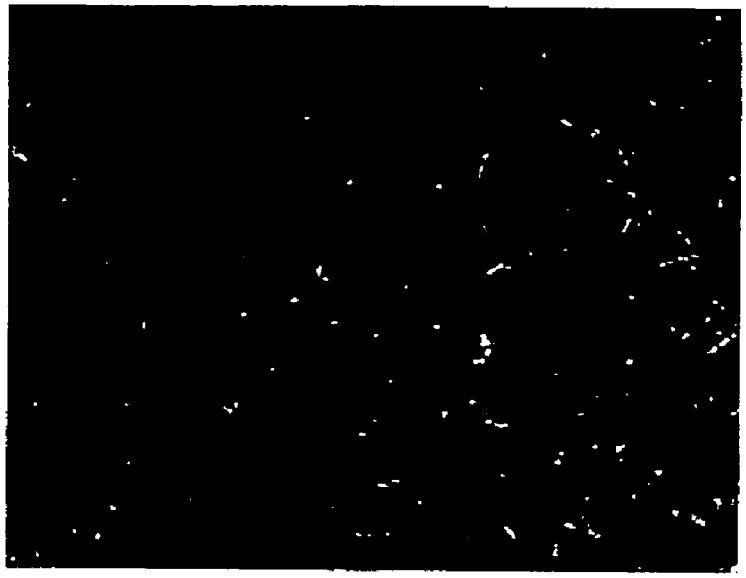
FIG. 17 is a figure of surface of test specimen surface observed by a microscope.

As shown as apparent from FIG. 17, linear concave (treated portion) can be observed on the surface of member to be processed, which makes the boundary between the processed portion and non-processed portion clear.

Using the nozzle by the present embodiment can form the shape of the treated portion into the spiral shape, and various shapes shown in FIG. 19. These shapes are realized by suitable combination of the feeding speed of the nozzle and on/off of the water flow. It also can be performed by masking the surface of member to the process. Further, the shapes other than the shape shown in FIG. 19 can be realized.

Figure 18:
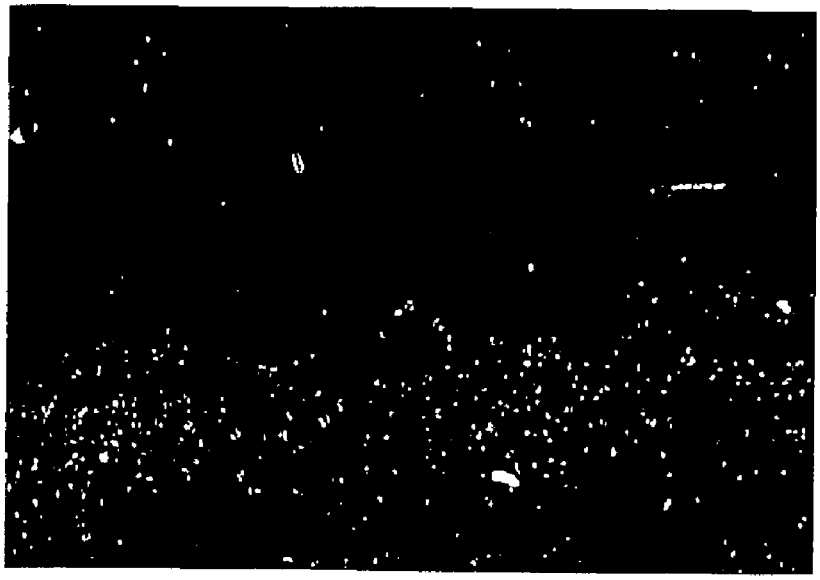
FIG. 18 is an enlarged figure of the figure shown in FIG. 17.
Figure 19A:
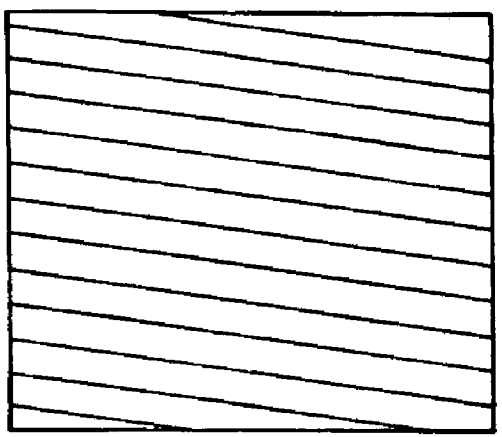
FIG. 19 is a figure showing sample of surface pits (linear concave) on the member to the processed.
Figure 19B:
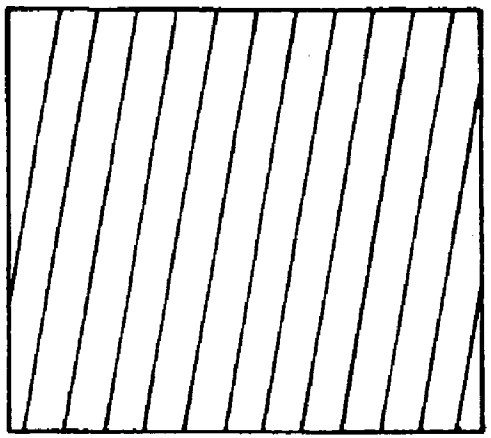
Figure 19C:
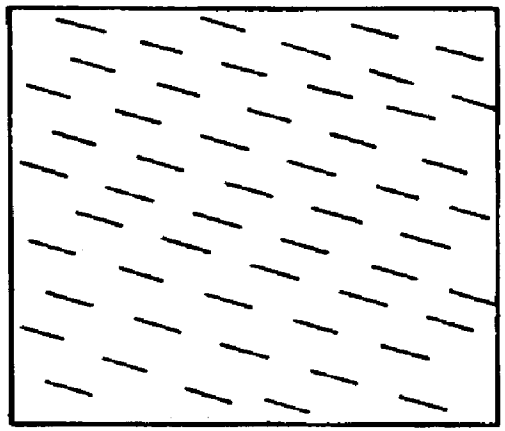
Figure 19D:
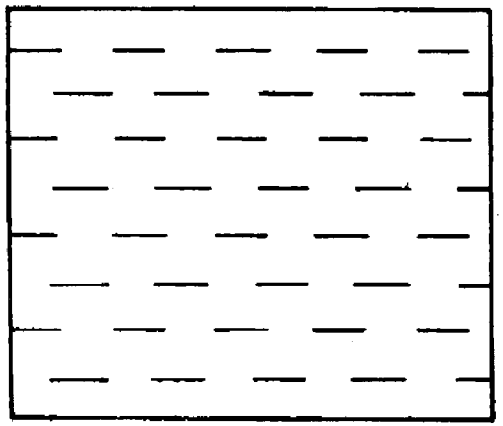
Figure 19E:
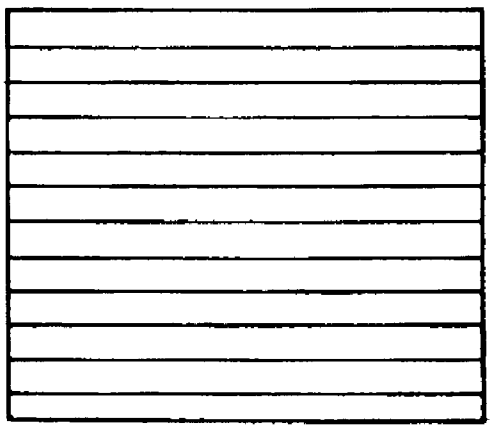
Figure 19F:
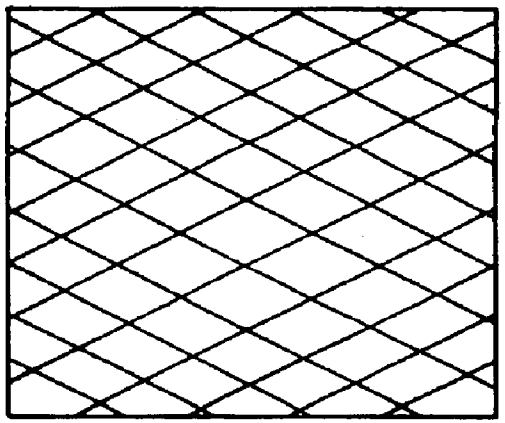

The treated portion of the present embodiment looks like liner in macro observation. However, as shown in FIG. 18 which is the enlarged figures of circled portion of FIG. 17, it is assembly of plural fine pits similar to the other embodiments in the micro observation.

(Embodiment 10)

(Pit Formation)

1. After balling the inner surface of aluminum liner made of PMC, honing process is performed Surface roughness of the honing finish is smaller than 0.5 Rz.

2. The nozzle same as the nozzle in the above embodiment 9 is used.

3. The PMC aluminum liner is subjected to the high pressure water treatment. As the treating condition, the inject pressure of the high pressure water is 300 MPa, rotating speed of the nozzle is 650 rpm, and moving speed of the nozzle is 60 mm/sec.

(Surface condition)

Figure 20:
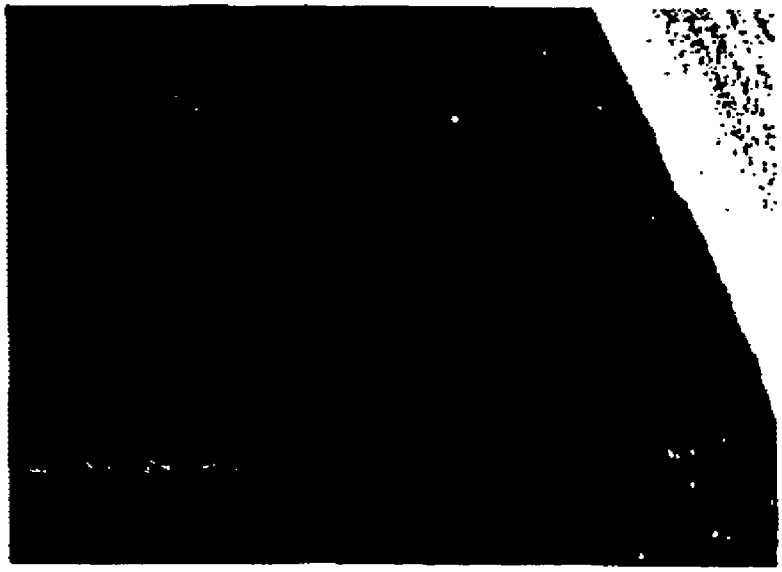
FIG. 20 is a figure of surface of test specimen of the embodiment 10 before treatment observed by a microscope.
Figure 21:
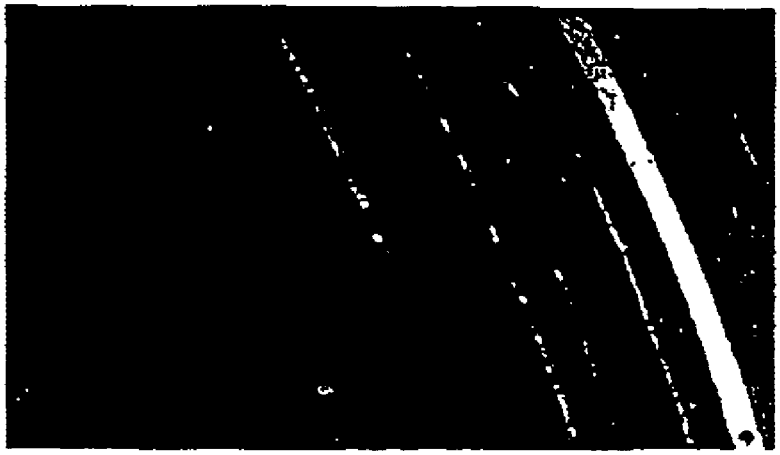
FIG. 21 is a figure of surface of test specimen of the embodiment 10 after treatment observed by a microscope.

Surface condition of the PMC aluminum is same as that of the cast iron liner. That is, as apparent from comparison the condition prior to treatment (FIG. 20) and condition post treatment (FIG. 21), the liner concave (treated portion) can be observed on the surface of the member to be process similar to the embodiment 9. It makes boundary between the processed portion and non-processed portion clear.

(Embodiment 11)

(Pit Formation)

1. After balling the inner surface of liner made of cast iron (FC 230), the honing process is performed. Surface roughness of the honing finish is smaller than 1.0 Rz.

2. The FC liner is subjected to the high pressure water treatment. As the treating condition, the inject pressure of the high pressure water is 300 MPa, rotating speed of the nozzle is 650 rpm, and moving speed of the nozzle is 4 mm/sec.

3. After the high pressure treatment, the surface is subjected to the honing process to make surface roughness of the terrace portion smaller than 0.5 Rz. Margin of the honing is selected so that depth of the pits larger than 5 $\mu$m is secured.

(Surface condition)

Figure 22:
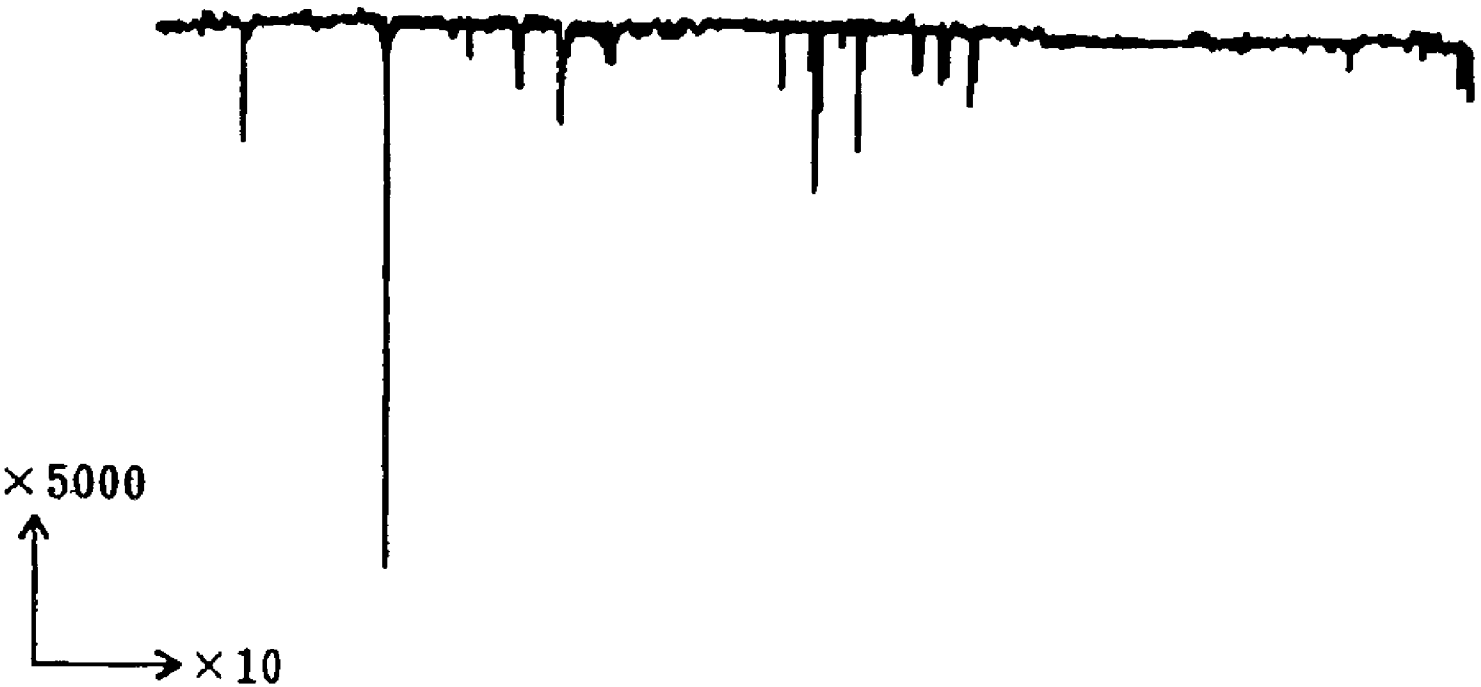
FIG. 22 is a figure showing one sample of cross section curve of the embodiment 11.

By the high pressure water treatment, as shown in FIG. 22, the pits having sharp peaks can be formed without largely influencing surface roughness of the surface.

Accordingly, it has become apparent that the pits formed by the present forming method are left without being broken by the succeeding mechanical process such as honing. In the other material, in addition to the cast iron, the mechanical process can be made after formation of the pits, although not shown.

(Comparative samples 3 to 6)

(Specimen)

As the test specimen of the comparative samples, the specimen in which cross hatches are formed on the surface by the honing process (comparative samples 3), specimen which is subjected to the fine shot peening treatment (comparative sample 4), specimens which has the mirror surface (0.5 Rz) formed by the honing process for the FC liner and aluminum liner (comparative samples 5 and 6) are prepared.

(Surface condition)

Figure 24:
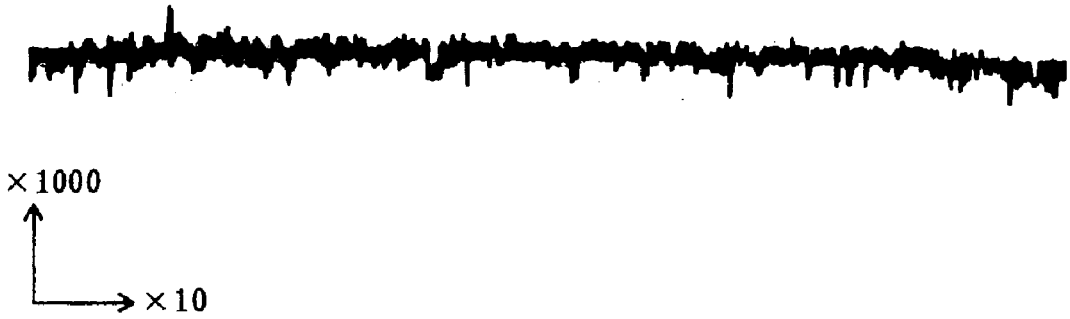
FIG. 24 is a figure showing one sample of cross section curve of comparative sample 3.
Figure 25:
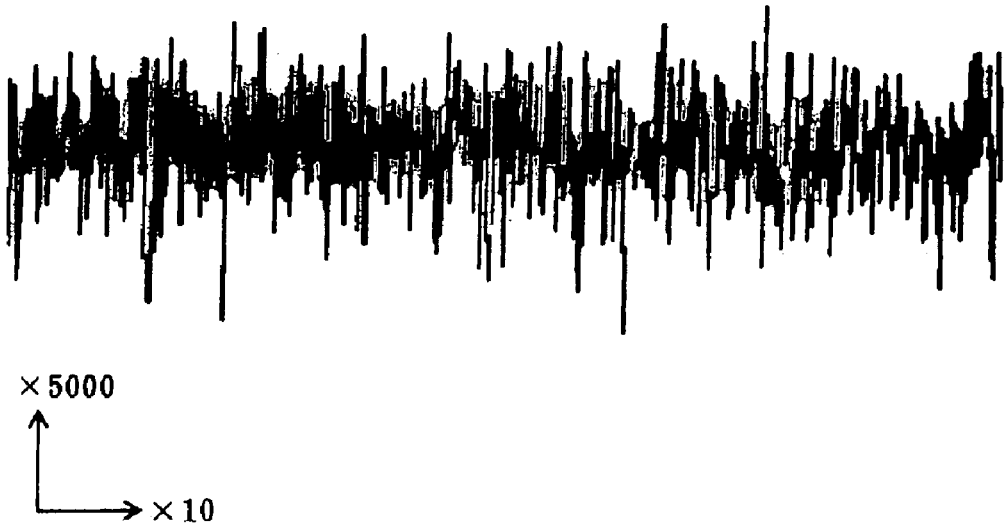
FIG. 25 is a figure showing one sample of cross section curve of comparative sample 4.
Figure 26:
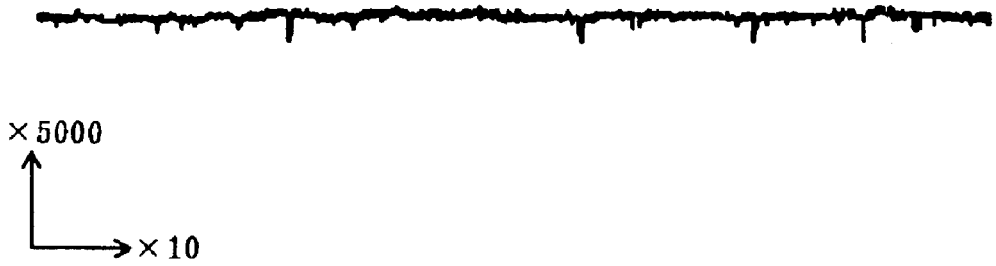
FIG. 26 is a figure showing one sample of cross section curve of comparative sample 5.
Figure 27:
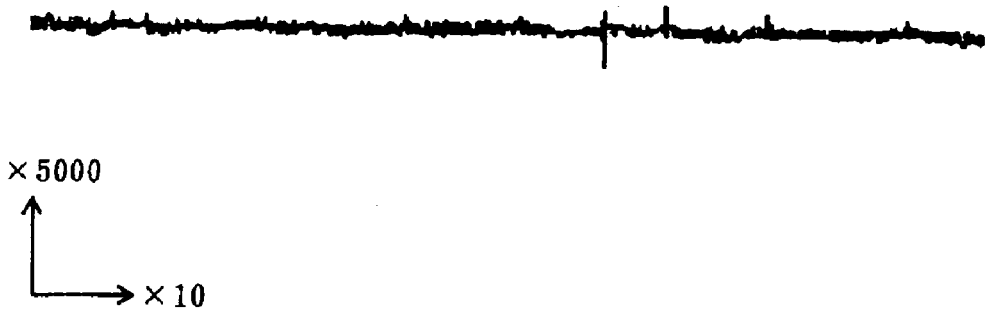
FIG. 27 is a figure showing one sample of cross section curve of comparative sample 6.

The surface roughness of the surface of the comparative sample 3 is 2.8 μmRz (FIG. 24). Cross section shape of the specimen of the comparative sample 4 subjected to the fine particles shot peening treatment is shown in FIG. 25, the cross section shape of the specimen of the comparative samples 5 and 6 subjected to the mirror surface process are shown in FIGS. 26 and 27.

<Test>

(Measuring test of Friction coefficient)

Influence of the pit depth and average of pits distance (length of the portion not subjected to the injection) to friction coefficient are measured.

The average value of the pits distance, in the normal hole-like pit, represents the average value of the pit depth and shortest distance between pits. It represents, in the linear pits group of the embodiments 9 and 10, the average distance between the linear pit group and the adjacent linear pits group.

Test is performed by sliding the test piece and the nitride piston ring in 300 cycles/sec., slide width of 40 mm, and Hertz stress of 160 MPa. The test piece is prepared by cutting a part of the test specimens of the embodiments 5 to 11 and comparative samples 3 to 6. They are obtained by injecting the high pressure water to the inner surface of the liner and bore having inner diameter of 82 to 86 mm.

The oil of SJ class 5W-30 by 1 ml/min. is dropped (the surface being always lubricated by the oil) and sprayed.

(Result)

Figure 23:
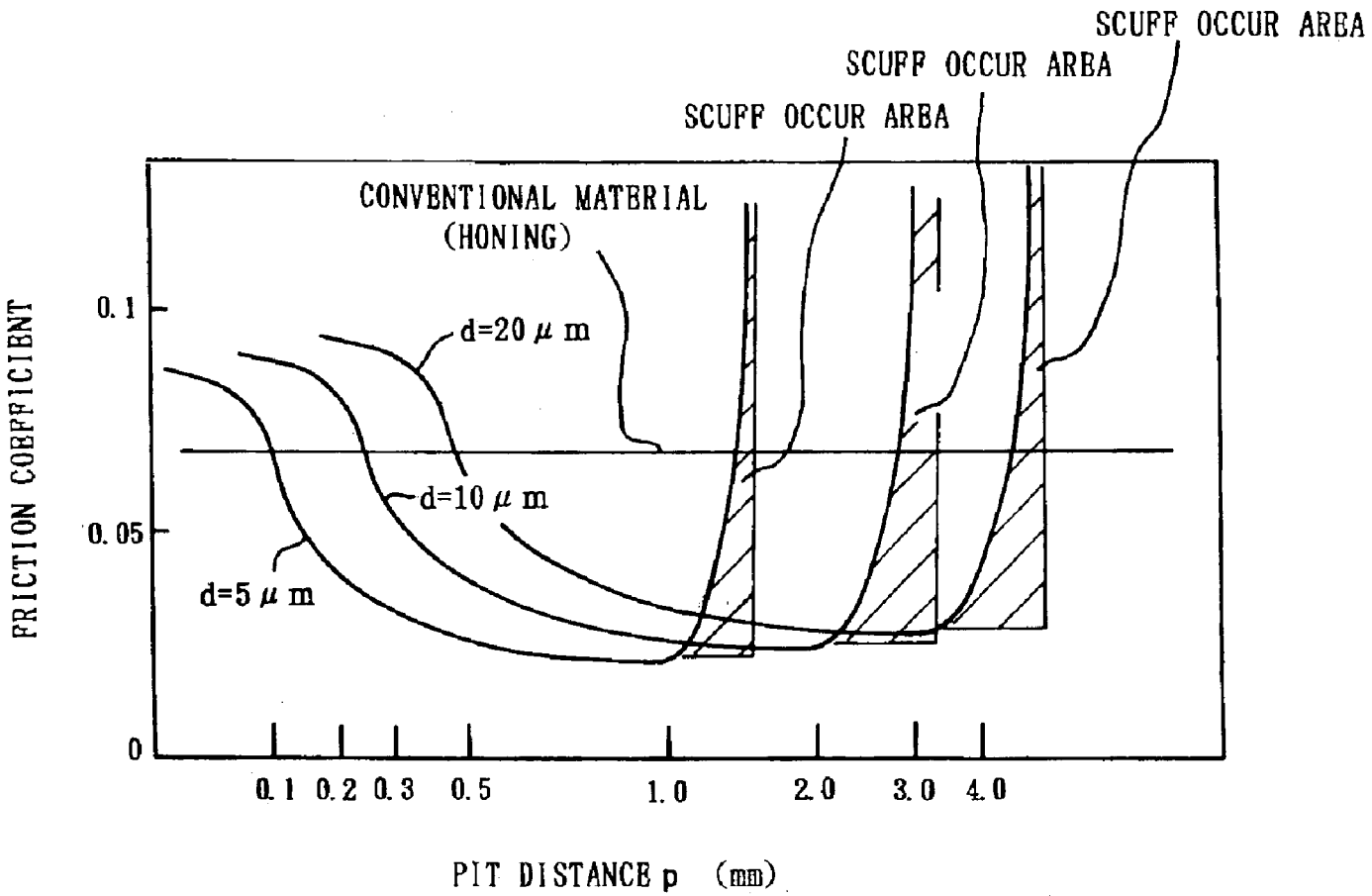
FIG. 23 is a figure showing relation between pits distance and friction coefficient of the embodiment 5 to 11 and comparative samples 3 to 6.

Result is shown in FIG. 23. The pit depth is represented by d, and the average value between pits distance is represented by p. As apparent from it, the pits distance of 0.1 to 1.4 mm in the pit depth of 5 μm, and the pits distance of 0.25 to 2.8 mm in the pit depth of 10 μm, and the pits distance of 0.4 to 4.5 mm in the pit depth of 20 μm reveal the lower friction coefficient than the surface subjected to the conventional honing treatment. Therefore, the preferable general relation between the pit depth (d) and the pits distance (p) is represented $20d \leqq p \leqq 200d$. When p becomes smaller than 20d the friction coefficient suddenly increases, while it becomes larger than 200d scuff due to shortage of the oil will occur. The relation between the pit depth and length of the portion not subjected to injection of the high pressure fluid has same tendency as the relation between the pit depth and pits distance, although not shown.

(Scuff occurrence test)

Relation between the friction coefficient and time up to occurrence of scuff is measured. Test is performed by sliding the test piece and the nitride piston ring in 300 cycles/sec., slide width of 40 mm, and Hertz stress of 160 MPa. The test piece is prepared by cutting a part of the test specimens of the embodiments 5 to 11 and comparative samples 3 to 6. They are obtained by injecting the high pressure water to the inner surface of the liner and bore having inner diameter of 82 to 86 mm. The Hertz stress is set in 160 MPa in measuring the friction coefficient, and is set in 48 MPa in measuring the time up to occurrence of the scuff. To the friction surface the oil of SJ class 5W-30 is supplied before the start of test by 0.3 mg/cm$^2$.

(Result)

Figure 28:
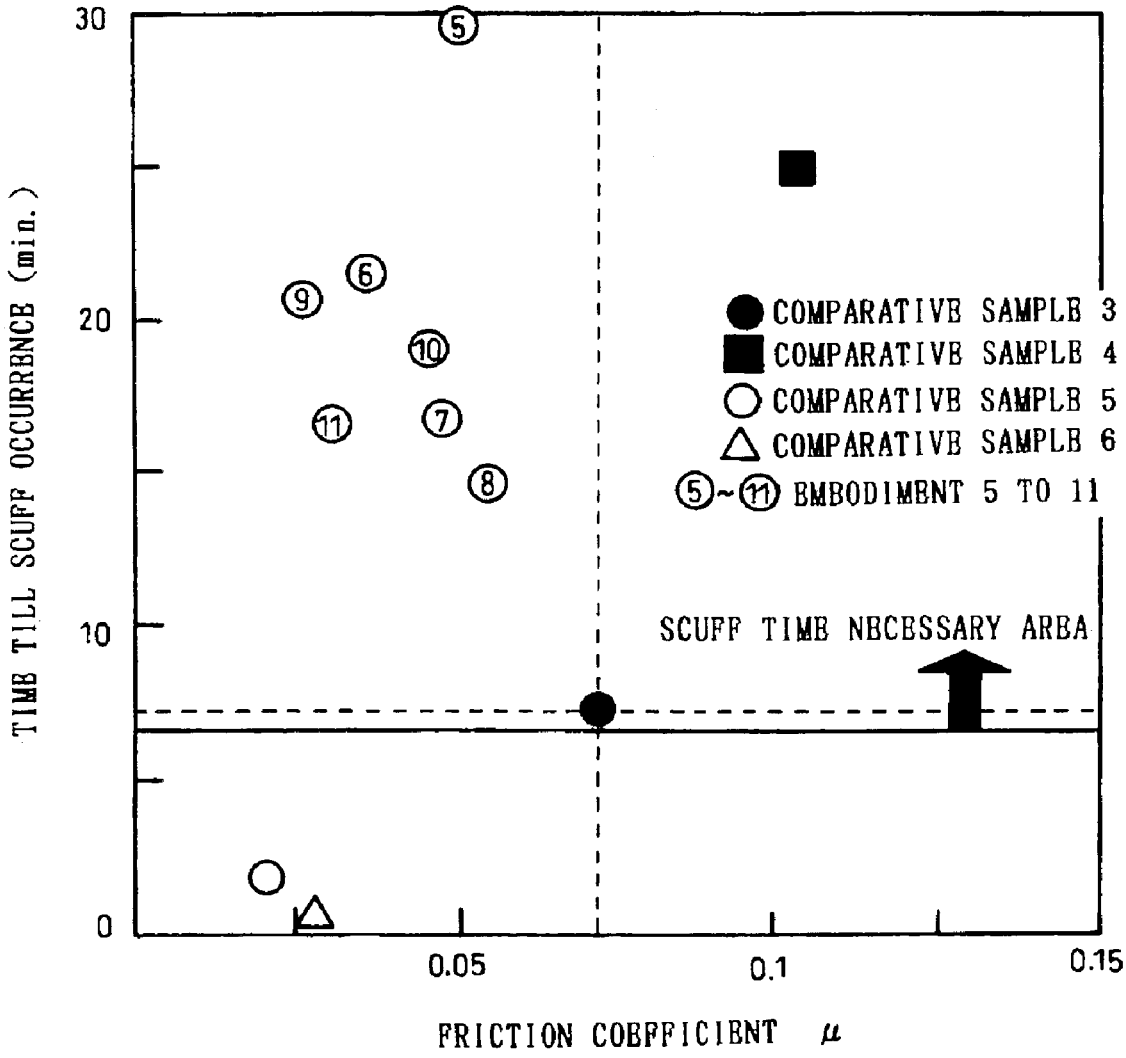
FIG. 28 is figure showing relation between friction co-efficient and time period till scuff occurrence for test specimens of the embodiments 5 to 11 and the comparative sample 3 to 6.

Result is shown in FIG. 28. As apparent from it. The test specimen subjected to the high pressure water treatment of each embodiment has small friction efficient and long time up to occurrence of scuff, compared with the test specimen subjected to the cross hatch process by the conventional honing (comparative sample 3). In the test specimen of the comparative samples 5 and 6 subjected to the mere mirror surface treatment have small friction initially, but has small time up to occurrence of scuff compared with the comparative sample 3. Preferable quality of each specimen of the embodiments 5 to 11 seems to be resulted from small surface roughness can reduce friction, and the pits having suitable depth and number function as the oil storage to prevent scuff.

In the test specimens of the comparative sample 4 subjected to the fine particle shot peening, dimple functions as the oil storage to have good scuff proof character. However, as shown in FIG. 24, it has spreaded convexes and concaves and does not have the terrace portion necessary for low friction coefficient. Consequently, the friction coefficient becomes larger.

As described in the above, the present invention can provide the forming method of the surface pits which is simple and in expensive, and the member having the surface pits.

What is claimed is:

1. A method of forming surface pits, comprising:

forming a member having a surface layer formed by at least two materials, at least one material forming a plurality of weak portions, another at least one material forming a plurality of high strength portions of relatively higher strength than the weak portions; and injecting high pressure fluid to impact the surface layer to remove at least a part of the plurality of weak portions to form pits, the high strength portions being substantially intact, and a surface roughness of the substantially intact high strength portions remaining substantially the same.

2. The method of forming surface pits according to claim 1, further comprising;

after forming the member, performing a surface flatten step on the surface layer portion.

3. The method of forming surface pits according to claim 1, wherein the injection injects the high pressure fluid only to part of the surface layer portion.

4. The method of forming surface pits according to claim 1, wherein the weak portion has a flaked shape, plate shape or fiber state.

5. The method of forming surface pits according to claim 1, wherein the surface layer is formed from flake graphite cast iron.

6. The method of forming surface pits according to claim 1, wherein the surface layer is formed from PMC aluminum in which aluminum alloy powders, ceramics powders and silicon particles are mixed and sintered.

7. The method of forming surface pits according to claim 1, wherein the surface layer is formed from MMC aluminum in which mullite particles and alumina-silica fibers are dispersed into aluminum base.

8. The method of forming surface pits according to claim 1, wherein the member is formed by complex frame spraying or complex plating.

9. A method of forming surface pits, comprising:

forming a member having a surface layer formed by at least two materials, at least one material forming a plurality of weak portions, another at least one material forming a plurality of high strength portions of relatively higher strength than the weak portions; and injecting high Pressure fluid to impact the surface layer to remove at least a part of the plurality of weak portions to form pits, wherein the injecting further removes at least portions of the plurality of high strength portions adjacent to the plurality of weak portions; and a surface roughness of substantially intact high strength portions remaining substantially the same.

10. A member, comprising:

a surface layer having a plurality of weak portions and a plurality of high strength portions, having relatively higher strength than the weak portions, the weak portions formed by at least one material, the high strength portions formed by another at least one material; and the surface layer having weak portions removed by high pressure fluid injection to form pits wherein the high strength portions remain substantially intact, and a surface roughness of the substantially intact high strength portions remaining substantially the same, wherein the surface layer has portions subjected to injection of high pressure fluid and portions not subjected to injection of high pressure fluid;

an average value of length of the portions not subjected to injection of the high pressure fluid is larger than an average value of length of the portions subjected to injection of the high pressure fluid, and is 20 to 200 times of an average value of pit depths.

11. A member having the surface pits according to claim 10 wherein a surface of the member having the pits is a surface of a cylinder bore and cylinder liner of an engine.

12. A member having the surface pits according to claim 10, wherein a surface of the member having the pits is a surface of a cylinder bore or cylinder liner of a compressor, or a surface of a swash plate or shoe of a swash-plate fashion volume variable-type compressor.

13. A member having the surface pits according to claim 10, wherein the surface layer portion is constructed by flake graphite cast iron, and the pits are formed by at least graphite particles being removed.

14. A member having the surface pits according to claim 10, wherein the surface layer portion is constructed by PMC aluminum in which aluminum alloy powders, ceramics powders and silicone particles are mixed and sintered.

15. A member having the surface pits according to claim 10, wherein the surface layer portion is constructed by MMC aluminum in which mullite particles and alumina-silica fibers are dispersed into aluminum base.

16. A member having the surface pits according to claim 10, wherein a surface of the member having the pits is flat.

* * * * *